US008860355B2

(12) United States Patent
Ueda et al.

(10) Patent No.: US 8,860,355 B2
(45) Date of Patent: Oct. 14, 2014

(54) MOTOR CONTROL DEVICE

(75) Inventors: Koichiro Ueda, Tokyo (JP); Hidetoshi Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 59 days.

(21) Appl. No.: 13/699,343

(22) PCT Filed: May 19, 2011

(86) PCT No.: PCT/JP2011/061556

§ 371 (c)(1),
(2), (4) Date: Nov. 21, 2012

(87) PCT Pub. No.: WO2012/008222

PCT Pub. Date: Jan. 19, 2012

(65) Prior Publication Data

US 2013/0063068 A1 Mar. 14, 2013

(30) Foreign Application Priority Data

Jul. 14, 2010 (JP) ..... 2010-159836

(51) Int. Cl.
*G01C 19/30* (2006.01)

(52) U.S. Cl.
USPC ..... 318/689; 318/560; 318/561; 318/609; 318/632

(58) Field of Classification Search
USPC ..... 318/689, 560, 561, 609, 610, 632, 318/720–72; 72/453.13, 454; 264/40.5, 264/40.3; 700/200
See application file for complete search history.

(56) References Cited

U.S. PATENT DOCUMENTS

| | | | | |
|---|---|---|---|---|
| 4,828,473 | A * | 5/1989 | Otake et al. | 425/145 |
| 6,936,990 | B2 * | 8/2005 | Oyama et al. | 318/632 |
| 6,994,537 | B2 * | 2/2006 | Liu et al. | 425/143 |
| 7,331,208 | B2 * | 2/2008 | Fujibayashi et al. | 72/454 |
| 7,344,664 | B2 * | 3/2008 | Kamiguchi et al. | 264/40.5 |
| 7,462,025 | B2 * | 12/2008 | Uchiyama et al. | 425/143 |
| 7,739,894 | B2 * | 6/2010 | Suzuki | 72/454 |
| 7,824,164 | B2 * | 11/2010 | Hakoda et al. | 425/145 |
| 7,845,205 | B2 * | 12/2010 | Iwashita et al. | 72/454 |
| 7,904,196 | B2 * | 3/2011 | Okazaki | 700/203 |
| 8,037,735 | B2 * | 10/2011 | Kohno et al. | 72/453.13 |
| 8,042,375 | B2 * | 10/2011 | Suzuki | 72/453.13 |

(Continued)

FOREIGN PATENT DOCUMENTS

| | | |
|---|---|---|
| JP | 2007 237312 | 9/2007 |
| JP | 2008 73713 | 4/2008 |

*Primary Examiner* — Paul Ip
(74) *Attorney, Agent, or Firm* — Oblon, Spivak, McClelland, Maier & Neustadt, L.L.P.

(57) ABSTRACT

A motor-control-device main unit includes a pressure-command-signal generating section, a pressure control section, a speed control section, a current control section, and a parameter-adjusting section. With respect to a parameter for a control computation by the pressure control section, the parameter-adjusting section includes an information-acquiring section and a parameter-calculating section. The information-acquiring section acquires, from an exterior, each of pieces of information including an elastic constant of a pressurized target, a reaction-force constant indicating information of a reaction force, a transfer characteristic from a motor torque to a motor speed, and parameters of the speed control section. The information-acquiring section previously acquires information of a control law of the speed control unit. The parameter-calculating section calculates a parameter for the pressure control section based on the information acquired by the information-acquiring section.

10 Claims, 26 Drawing Sheets

(56) References Cited

U.S. PATENT DOCUMENTS

| | | | | |
|---|---|---|---|---|
| 8,089,226 | B2 * | 1/2012 | Matsutani et al. | 318/68 |
| 8,119,044 | B1 * | 2/2012 | Akasaka | 264/40.7 |
| 8,229,592 | B2 * | 7/2012 | Akasaka | 700/200 |
| 2003/0062643 | A1 * | 4/2003 | Bulgrin et al. | 264/40.1 |
| 2003/0184251 | A1 * | 10/2003 | Oyama et al. | 318/607 |
| 2004/0119183 | A1 * | 6/2004 | Liu et al. | 264/40.5 |
| 2005/0206025 | A1 * | 9/2005 | Kamiguchi et al. | 264/40.5 |
| 2006/0012326 | A1 * | 1/2006 | Iwashita et al. | 318/645 |
| 2006/0145379 | A1 * | 7/2006 | Okazaki | 264/40.1 |
| 2006/0276927 | A1 * | 12/2006 | Uchiyama et al. | 700/203 |
| 2007/0084264 | A1 * | 4/2007 | Iwashita et al. | 72/350 |
| 2007/0210740 | A1 | 9/2007 | Sato et al. | |
| 2008/0066515 | A1 | 3/2008 | Iwashita et al. | |
| 2009/0078016 | A1 * | 3/2009 | Suzuki | 72/20.1 |
| 2009/0087510 | A1 * | 4/2009 | Hakoda et al. | 425/149 |
| 2009/0126453 | A1 * | 5/2009 | Suzuki | 72/453.13 |
| 2011/0298146 | A1 * | 12/2011 | Akasaka | 264/40.3 |
| 2012/0104642 | A1 * | 5/2012 | Akasaka | 264/40.3 |
| 2013/0033220 | A1 | 2/2013 | Ueda | |
| 2013/0033221 | A1 | 2/2013 | Ueda et al. | |
| 2013/0147078 | A1 * | 6/2013 | Matsubayashi et al. | 264/40.3 |

* cited by examiner

MOTOR CONTROL DEVICE

TECHNICAL FIELD

The present invention relates to a motor control device which controls driving of a motor for pressing a mechanical load against a target.

BACKGROUND ART

In various types of molding machines such as injection-molding machines and press-molding machines and processing apparatus such as bonding machines (industrial machines and processing machines), an electric mechanism (mechanical driving section) is driven by a motor to apply a pressure to a pressurized target. In the processing apparatus described above, an actual pressure value, which is a pressure value obtained when a mechanical load is pressed against a molding material or a work piece which is the pressurized target, is detected as a pressure detection value. Based on the pressure detection value and a pressure command value, a pressure control computation defined by a parameter is performed. The parameter as used herein is a parameter such as a gain in the pressure control computation.

It is necessary to appropriately adjust the parameter for the pressure control computation. When the parameter is too large, the stability of a control system is impaired, resulting in instability of the control system or occurrence of a vibration phenomenon in which a high-frequency micro-vibration is superimposed on the pressure applied to the pressurized target. By the transmission of the micro-vibration generated by the vibration phenomenon to the work piece or the like, the result of processing is adversely affected.

On the other hand, when the parameter is too small, a phenomenon in which long time is required to achieve a target pressure value (pressure command signal) or the like is brought about. When an external disturbance is applied, there is a fear in that the external disturbance cannot be sufficiently removed. In particular, a compensation for the external disturbance cannot be performed only by feedforward control for operating the motor based not on both the pressure detection value and the target pressure value but only on the target pressure value. The removal can be performed only by performing the pressure control computation based on the pressure detection value and the target pressure value to perform the operation of the motor. Therefore, it is important to appropriately adjust the parameter of the pressure control computation.

Moreover, for example, in the case of a conventional apparatus described in Patent Literature 1, in pressure control in which a pressure deviation (difference) between the pressure detection value and the target pressure value is multiplied by a pressure gain to determine a speed command of the motor and a speed control computation is performed to follow the speed command, an elastic constant of the pressurized target is obtained by a calculation and is then divided by a predetermined proportionality constant to calculate a pressure gain.

CITATION LIST

Patent Literature

[PTL 1]: JP 2008-73713 A

SUMMARY OF INVENTION

Technical Problem

The conventional apparatus described above has a problem in that there is provided no guideline for how to determine the predetermined proportionality constant itself and therefore, the predetermined proportionality constant is required to be adjusted by trial and error. Moreover, in general, for controlling the pressure, a reaction force is generated at the time of generation of the pressure. The reaction force affects the control system. In the conventional apparatus described above, however, the parameter of the pressure control computation is calculated without using information regarding the reaction force. Therefore, there is a problem in that the parameter for appropriately executing the pressure control cannot be calculated.

Further, as one of evaluation indices for adjusting the parameter of the pressure control computation, it is necessary to ensure the stability of the control system in order to adjust the gain parameter. The stability of the control system is not determined only by the parameter relating to the pressure control. Thus, the gain parameter of the pressure control is required to be adjusted in consideration of the stability of a control loop (speed control loop for the conventional apparatus described in Patent Literature 1) corresponding to a minor loop thereof. For the conventional apparatus described above, however, the stability of the minor loop described above is not fully taken into consideration.

The problem describe above is generated not only in the pressure control but also in force control in a similar manner.

The present invention has been made to solve the problems described above and therefore, has an object to provide a motor control device capable of improving control performance while ensuring stability of a control system.

Solution to Problem

According to the present invention, there is provided a motor control device provided to an electric mechanism including a motor, the electric mechanism being connected to a mechanical load for applying a dynamic physical quantity corresponding to any one of a force and a pressure to a target, the electric mechanism displacing the mechanical load to press the mechanical load against the target to apply the dynamic physical quantity to the target by power of the motor, the motor control device including a motor-control-device main unit for acquiring a value of the dynamic physical quantity exerted from the mechanical load to the target as a physical-quantity acquisition value and generating a physical-quantity command value for making the physical-quantity acquisition value equal to a preset physical-quantity target value so as to control driving of the motor by using the physical-quantity acquisition value and the physical-quantity command value, the motor-control-device main unit including: a physical-quantity control section for calculating a speed command value based on the physical-quantity acquisition value and the physical-quantity command value; a speed control section for calculating a torque command value or a thrust command value for the motor based on a motor-speed detection value detected by speed detecting means for detecting a motor speed of the motor and the speed command value calculated by the physical-quantity control section; a current control section for controlling a current flowing through the motor based on the torque command value or the thrust command value, which is calculated by the speed control section; and a pressure-control-parameter adjusting section including an information-acquiring section for acquiring information of an elastic constant of the target, information regarding a reaction force of a motor torque or a thrust, the reaction force being generated with exertion of the dynamic physical quantity from the mechanical load to the target, information of a transfer characteristic from the motor torque or the thrust to the motor speed, a motor position, or a motor acceleration, information of a control law of the speed control section, and information of a parameter of the speed control section, the pressure-control-parameter adjusting section using a fact that a transfer characteristic from a signal of the physical-quantity acquisition value to the motor speed is a transfer characteristic containing a differential characteristic having a reciprocal of the elastic constant of the target as a proportionality constant and the information acquired by the information-acquiring section to adjust a parameter of the physical-quantity control section.

Advantageous Effects of Invention

According to the motor control device of the present invention, by using each of the pieces of information including the elastic constant of the target, the information regarding the reaction force of the motor torque or the thrust, generated with the application of the dynamic physical quantity from the mechanical load to the target, the information of the transfer characteristic of the motor torque or the thrust to the motor speed, the motor position, or the motor acceleration, the information of the a control law of the speed control section, and the information of the parameter of the speed control section, and the transfer characteristic of the signal of the physical-quantity acquisition value to the motor speed, which includes the differential characteristic having the reciprocal of the elastic constant of the target as the proportionality constant, the parameter-adjusting section determines the parameter of the physical-quantity control section. Therefore, the control performance can be improved while the stability of the control system is ensured.

DESCRIPTION OF EMBODIMENTS

Figure 1:
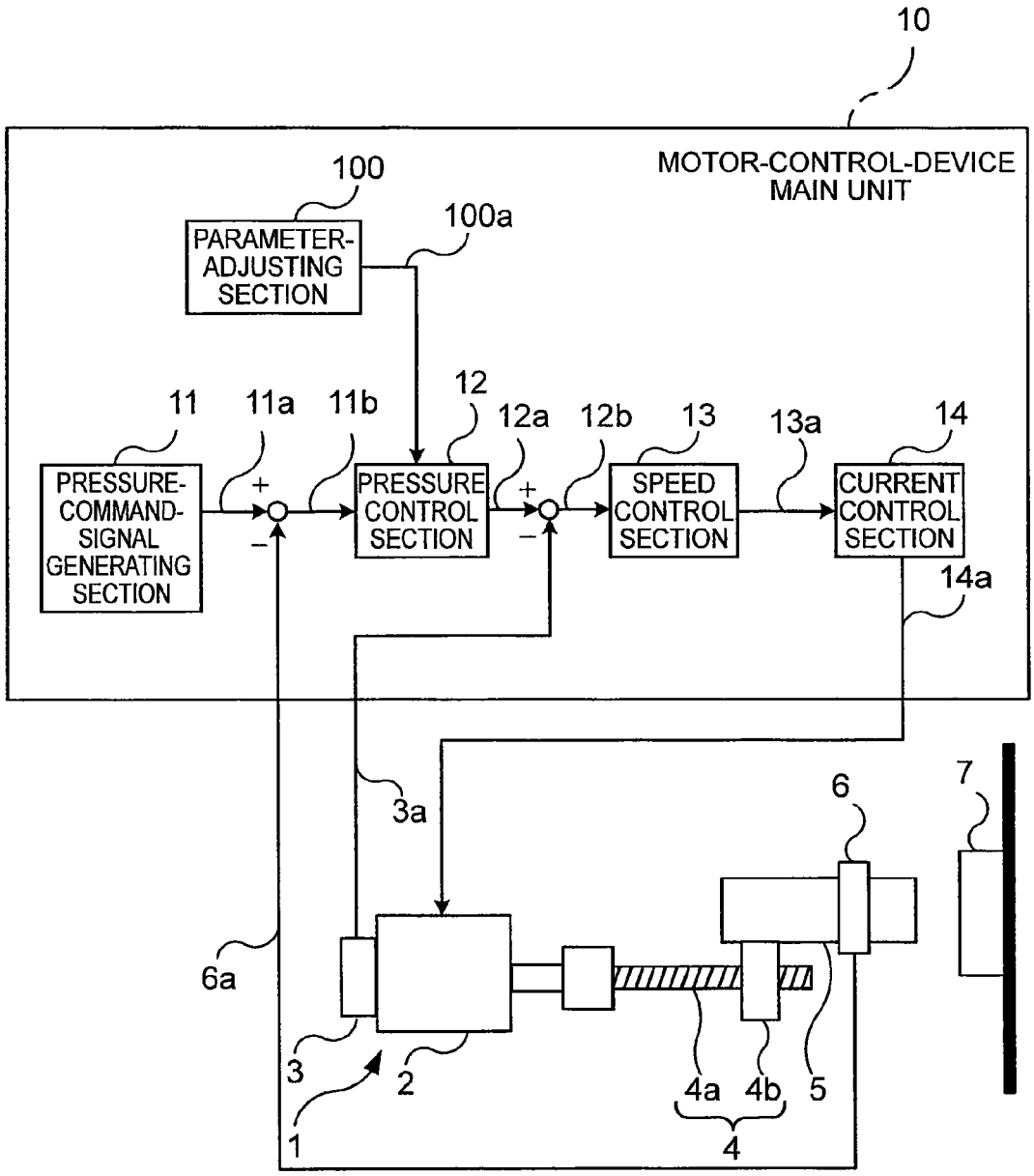
FIG. 1 A block diagram illustrating a motor control device according to a first embodiment of the present invention.

Hereinafter, modes for carrying out the present invention are described referring to the drawings.

First Embodiment

FIG. 1 is a block diagram illustrating a motor control device according to a first embodiment of the present invention.

In FIG. 1, a processing device 1 includes an electric mechanism 4 including a rotary type motor (pressurizing motor) 2 and an encoder 3, a mechanical load (pressing member) 5, and a pressure detector 6.

The encoder 3 is speed detecting means for generating a motor-speed detection signal 3*a* in accordance with a rotating speed of the motor 2. The electric mechanism 4 is a feed-screw mechanism for converting rotational movement into translational movement, and includes a screw 4*a* and a ball-screw nut 4*b*. The screw 4*a* is rotated by the motor 2 in a circumferential direction thereof. The ball-screw nut 4*b* is displaced in an axial direction of the screw 4*a* with the rotation of the screw 4*a*.

The mechanical load 5 is mounted to the ball-screw nut 4*b*. A distal end of the mechanical load 5 is opposed to the pressurized target 7 (target). The mechanical load 5 is displaced in the axial direction of the screw 4*a* together with the ball-screw nut 4*b*. The pressurized target 7 is pressurized by the mechanical load 5. The pressure detector 6 is mounted to the mechanical load 5. The pressure detector 6 is, for example, a load cell, various force sensors, or the like. Further, the pressure detector 6 is pressure detecting means (physical-quantity detecting means) for generating a pressure detection signal 6*a* in accordance with a pressure (dynamic physical quantity) at the time of pressurization of the pressurized target 7 by the mechanical load 5.

The driving of the motor 2 is controlled by a motor-control-device main unit 10. The motor-control-device main unit 10 includes a pressure-command-signal generating section 11, a pressure control section 12, a speed control section 13, a current control section 14, and a parameter-adjusting section (parameter-adjusting device) 100. The pressure-command-signal generating section 11 generates a signal of a pressure command value (physical-quantity command value) which is a command value of a pressure to be applied to the pressurized target 7, that is, a pressure command signal 11*a*.

The pressure control section 12 receives a signal 11*b* of a deviation (difference) between the pressure command value of the pressure command signal 11*a* from the pressure-command-signal generating section 11 and a pressure detection value (physical-quantity acquisition value) of the pressure detection signal 6*a* from the pressure detector 6. For the pressure detection signal 6*a*, the pressure detection signal 6*a* itself from the pressure detector 6 may be used. Alternatively, in place of the pressure detection signal 6*a*, a signal of an estimate of the pressure estimated by the pressure-command-signal generating section 11 from a speed or a current of the motor 2 may be used.

The pressure control section 12 executes a pressure control computation to calculate a speed command value in accordance with the deviation between the pressure command value and the pressure detection value so as to generate a speed command signal 12*a* which is a signal of the speed command value. As an example of the pressure control computation performed by the pressure control section 12, there is given proportional control, in which the deviation between the pressure command value and the pressure detection value is multiplied by a proportionality constant defined by a proportional gain (parameter for control) to output a speed command value. As another example of the pressure control computation by the pressure control section 12, proportional and integral control, phase advance/delay compensation control, or the like may be used. A parameter for the control computation by the pressure control section 12 is set based on parameter information 100*a* from the parameter-adjusting section 100.

The speed control section 13 receives a signal 12*b* of a deviation (difference) between the speed command value of the speed command signal 12*a* from the pressure control section 12 and a motor-speed detection value of the motor-speed detection signal 3*a* from the encoder 3. Moreover, the speed control section 13 executes a speed control computation based on the deviation between the speed command value and the motor-speed detection value to calculate a torque command value for calculating a torque to be generated by the motor 2 so as to generate a torque command signal 13*a* which is a signal thereof.

The current control section 14 receives the torque command signal 13*a* from the speed control section 13. Moreover, the current control section 14 supplies a current 14*a* for controlling the motor 2 to generate the torque as commanded by the torque command value. In this manner, there is realized pressure control in which the motor 2 generates a driving force so that the pressure detection value applied to the pressurized target 7 follows the pressure command value indicating a desired pressure.

In this case, in order that the pressure detection signal 6*a* may follow the pressure command value 11*a* with high responsiveness without causing an undesirable phenomenon in which the pressure detection signal 6*a* overshoots the pressure command value 11*a* or micro-vibrations are generated in the pressure detection signal 6*a*, the parameter of the pressure control section 12 (proportional gain in the case where the pressure control section 12 performs the proportional control) is required to be appropriately set. Although the illustration is omitted in FIG. 1, a pressure for the amount of a counteraction, which is generated when the pressure is applied to the pressurized target 7, becomes a torque (hereinafter, the torque is described as "reaction-force torque") through the mechanical load 5, the ball-screw nut 4*b*, and the screw 4*a*. Then, the reaction-force torque acts on the motor 2.

Figure 2:
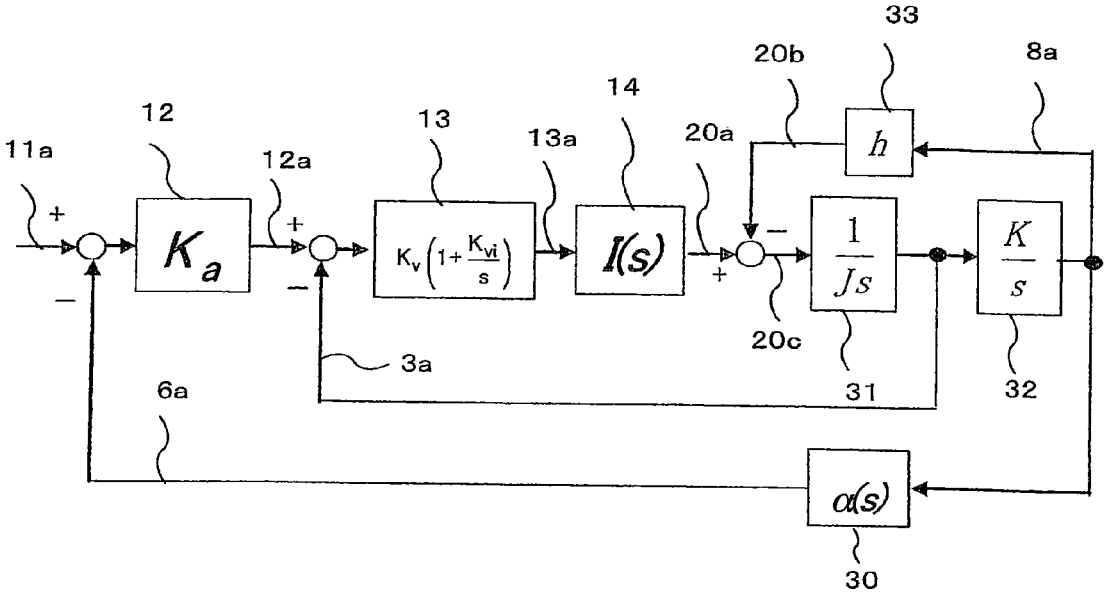
FIG. 2 A block diagram illustrating transfer characteristics of signals illustrated in FIG. 1.

Next, transfer characteristics of signals in the configuration illustrated in FIG. 1, which include a transfer characteristic of the reaction-force torque as described above, under conditions in which the mechanical load 5 is held in contact with the pressurized target 7, are described. FIG. 2 is a block diagram illustrating the transfer characteristics of the signals illustrated in FIG. 1. FIG. 2 illustrates the transfer characteristics of the respective functional blocks illustrated in FIG. 1 except for the pressure-command-signal generating section 11, the parameter-adjusting section 100, and the parameter information 100*a*. The reference symbol "s" described below in the specification and illustrated in FIG. 2 and the subsequent drawings represents a Laplace operator.

In FIG. 2, a motor-generated torque, which is generated by the motor 2 when the current control section 14 supplies the current 17 to the motor 2, is denoted by the reference symbol 20*a*. By the control performed by the current control section 14, a value of the motor-generated torque 20*a* and a value of the torque command signal 13*a* are approximately equal to each other. However, the motor-generated torque 20*a* exhibits a response delayed in terms of the transfer characteristic with respect to the torque command signal 13*a*. The transfer characteristic of the current control section 14 at this time is indicated by I(s) in FIG. 2.

The reference symbol 8*a* in FIG. 2 denotes an actual pressure generated in the pressurized target 7. The pressure detection signal 6*a* is ideally a signal indicating a value itself of the actual pressure 8*a*, but the pressure detection value of the pressure detection signal 6*a* sometimes exhibits some delay characteristic from the value of the actual pressure 8*a* because of hardware limitations of the pressure detector 6 or the like. The reference symbol 30 in FIG. 2 denotes a transfer characteristic indicating the delay in detection by the pressure detector 6, and the transfer characteristic is expressed as $\alpha(s)$.

As specific examples of the transfer characteristic $\alpha(s)$, $\alpha(s)=1$ is given when the delay in detection by the pressure detector 6 is negligible, $\alpha(s)=\exp(-T1\cdot s)$ is given when the detection by the pressure detector 6 is delayed by time T1, $\alpha(s)=\omega 1/(s+\Omega 1)$ or the like is given when a response frequency of the pressure detector 6 is $\omega 1$, and $\exp(-T1\cdot s)\times\omega 1/(s+\omega 1)$ or the like is given when the pressure detector 6 has the time T1 as a delay in detection and the response frequency is $\omega 1$. The response frequency $\omega 1$ and the delay time T1 are determined from hardware specifications of the pressure detector 6. The pressure detection value of the pressure detection signal 6*a* generated by the pressure detector 6 can be expressed as a value obtained by the action of $\alpha(s)$ on the value of the actual pressure 8*a*.

The reference symbol 31 in FIG. 2 denotes a transfer characteristic from a motor torque 20*c* corresponding to a difference between the motor-generated torque 20*a* and a reaction-force torque 20*b* to the motor speed. An example of the transfer characteristic is expressed by the following Expression (1).

[Math. 1]

$$\frac{1}{Js} \tag{1}$$

In this expression, J is a total inertia of a mechanically-movable portion. The total inertia of the mechanically-movable portion is a value obtained by converting a portion which moves when the motor 2 is driven into a motor-rotation inertia. In FIG. 1, the total inertia of the mechanically-movable portion is the sum of the respective inertias of the motor 2, the electric mechanism 4, the mechanical load 5, and the pressure detector 6.

The transfer characteristic from the motor torque 20*c* to the motor speed is not limited to the above-mentioned one, and may be a characteristic also expressing a resonance characteristic of a mechanical system. Specifically, the transfer characteristic from the motor torque 20*c* to the motor speed may be the one expressed by the following Expression (2) or the like.

[Math. 2]

$$\frac{1}{Js}\prod_{j=1}^{n}\frac{1+2(\zeta_{zi}/\omega_{zi})s+(s/\omega_{zi})^2}{1+2(\zeta_{ai}/\omega_{ai})s+(s/\omega_{ai})^2} \tag{2}$$

$\omega_{zi}$: i-th antiresonant frequency
$\xi_{zi}$: attenuation coefficient of i-th antiresonant frequency
$\omega_{ai}$: i-th resonant frequency
$\xi_{ai}$: attenuation coefficient of i-th resonant frequency
n: the number of resonances FIG. 2 illustrates the case where the pressure control section 12 uses the proportional control, and the proportional gain which is a parameter to be adjusted is indicated by Ka. Further, FIG. 2 also illustrates the case where the speed control section 13 uses the proportional and integral control, and the proportional gain is indicated by Kv and the integral gain is indicated by Kvi.

The reference symbol 32 in FIG. 2 denotes that the motor position obtained by integrating the motor-speed detection value of the motor-speed detection signal 3*a* and the actual pressure 8*a* have a proportional relationship. In this case, when the pressure control is performed, the pressure control has a property in which a larger pressure is generated as the mechanical load 5 moves closer to the pressurized target 7, in other words, the motor position becomes larger. Generally, the pressure detection value of the pressure detection signal 6*a* is proportional to the motor position. The alphabet K in the block denoted by the reference symbol 32 indicates an elastic constant of the pressurized target 7, which is a proportionality constant thereof.

When the pressure is to be applied to the pressurized target 7, the reaction force is inevitably generated as a counteraction thereof. This is a particular phenomenon which occurs when the pressure or the force is controlled but does not occur when the position or the speed is controlled. The reaction-force torque corresponding to the reaction force acts so as to block the operation of the motor 2, for pressurizing the pressurized target 7. In FIG. 2, the reaction-force torque is denoted by the reference symbol 20*b*.

The reference symbol 33 in FIG. 2 denotes a reaction-force constant h indicating information of the reaction force from the actual pressure 8*a* to the torque when the pressure is applied to the pressurized target 7. When a value of the actual pressure 8*a* is F and a value of the reaction-force torque 33*a* is Ta, the relationship: Ta=h·F is established.

When a lead of the feed-screw mechanism (ball screw) is p, the constant h can be expressed as: $h=p/(2\pi)$. Further, in the case where the feed-screw mechanism and the motor are coupled after the speed is changed through a transmission mechanism such as a speed reducer or a timing belt without directly coupling the motor and the feed-screw mechanism, when a transmission gear ratio (gear ratio) is 1/N (the motor speed is converted to be 1/N times larger through the transmission mechanism), the constant can be calculated as: $h=N\times p/(2\pi)$. The reference symbol 20*c* in FIG. 2 denotes a motor torque indicating a torque obtained by subtracting the reaction-force torque 20*b* from the motor-generated torque 20*a*. The motor torque acts on a machine as an actual torque.

Figure 3:
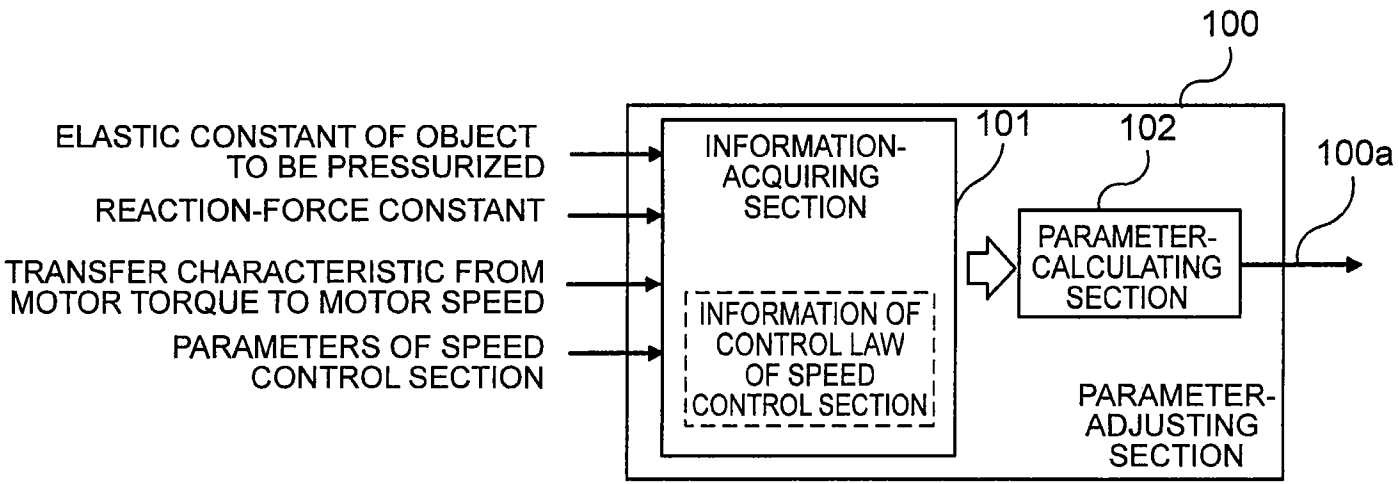
FIG. 3 A block diagram more specifically illustrating a parameter-adjusting section illustrated in FIG. 1.

Next, a configuration of the parameter-adjusting section 100 is described. FIG. 3 is a block diagram which more specifically illustrates the parameter-adjusting section 100 illustrated in FIG. 1. The parameter-adjusting section 100 includes an information-acquiring section (information section) 101 and a parameter-calculating section 102. The information-acquiring section 101 acquires, from the exterior, each of pieces of information including the elastic constant K of the pressurized target 7, the reaction-force constant h indicating information of the reaction force, the transfer characteristic from the motor torque 20*c* to the motor speed, represented by the above-mentioned Expressions (1) and (2), and the parameters Kv and Kvi of the speed control section 13.

The information-acquiring section 101 previously acquires (stores) information of a control law (specifically, the proportional and integral control in FIG. 2) of the speed control section 13. The parameter-calculating section 102 calculates a parameter (Ka in FIG. 2) of the pressure control section 12 based on the information acquired by the information-acquiring section 101.

Figure 4:
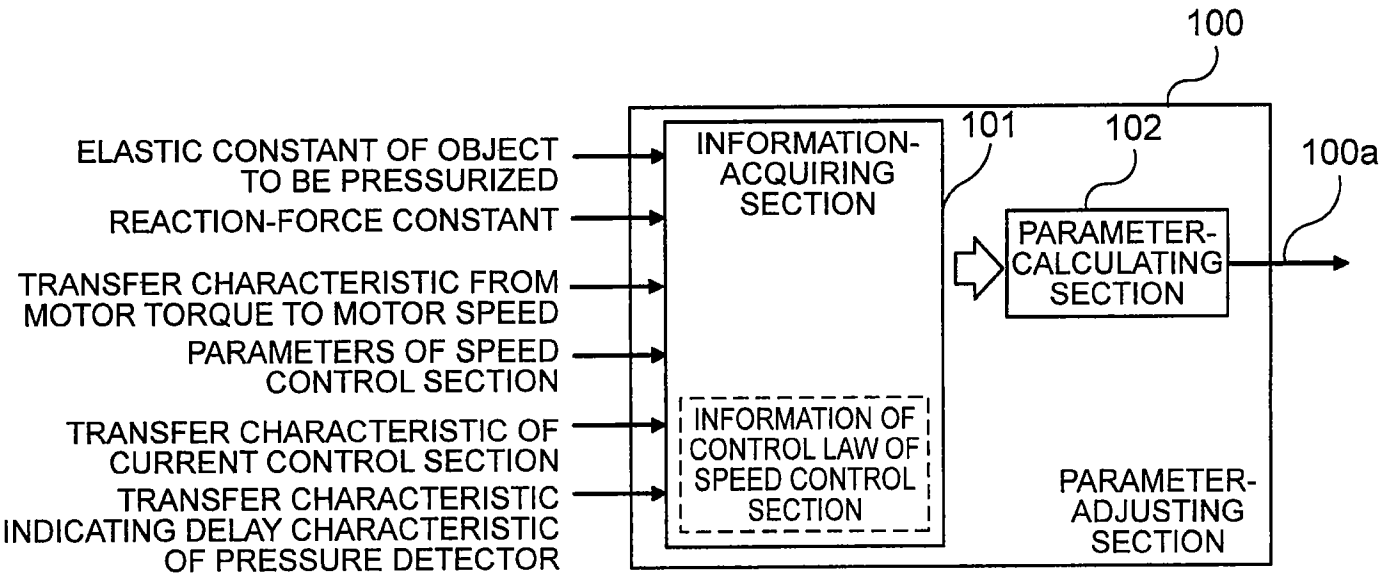
FIG. 4 A block diagram illustrating another example of the parameter-adjusting section illustrated in FIG. 1.

FIG. 4 is a block diagram illustrating another example of the parameter-adjusting section 100 illustrated in FIG. 1. The parameter-adjusting section 100 illustrated in FIG. 4 has a different mode from that of FIG. 3 and differs from the parameter-adjusting section 100 illustrated in FIG. 3 in that, besides the information illustrated in FIG. 3, the information of the transfer characteristic of the current control section 14 and the transfer characteristic indicating the detection delay characteristic of the pressure detector 6 is acquired by the information-acquiring section 101. Moreover, in FIG. 4, the information-acquiring section 101 may acquire the information of the transfer characteristic indicating the detection delay characteristic of the pressure detector 6 so as to omit the acquisition of the information of the transfer characteristic of the current control section 14. Conversely, the information-acquiring section 101 may acquire information of the transfer characteristic of the current control section 14 so as to omit the acquisition of the information of the transfer characteristic indicating the characteristic of the detection delay of the pressure detector 6.

In this case, the motor-control-device main unit 10 may include a computer (not shown) including a computation processing section (CPU), a storage section (ROM, RAM and the like), and a signal input/output section, an inverter (not shown) for supplying a current to the motor, and the like. In the storage section of the computer of the motor-control-device main unit 10, programs for realizing the functions of the pressure-command-signal generating section 11, the pressure control section 12, the speed control section 13, the current control section 14, the parameter-adjusting section 100, the information-acquiring section 101, and the parameter-calculating section 102 are stored.

Figure 5:
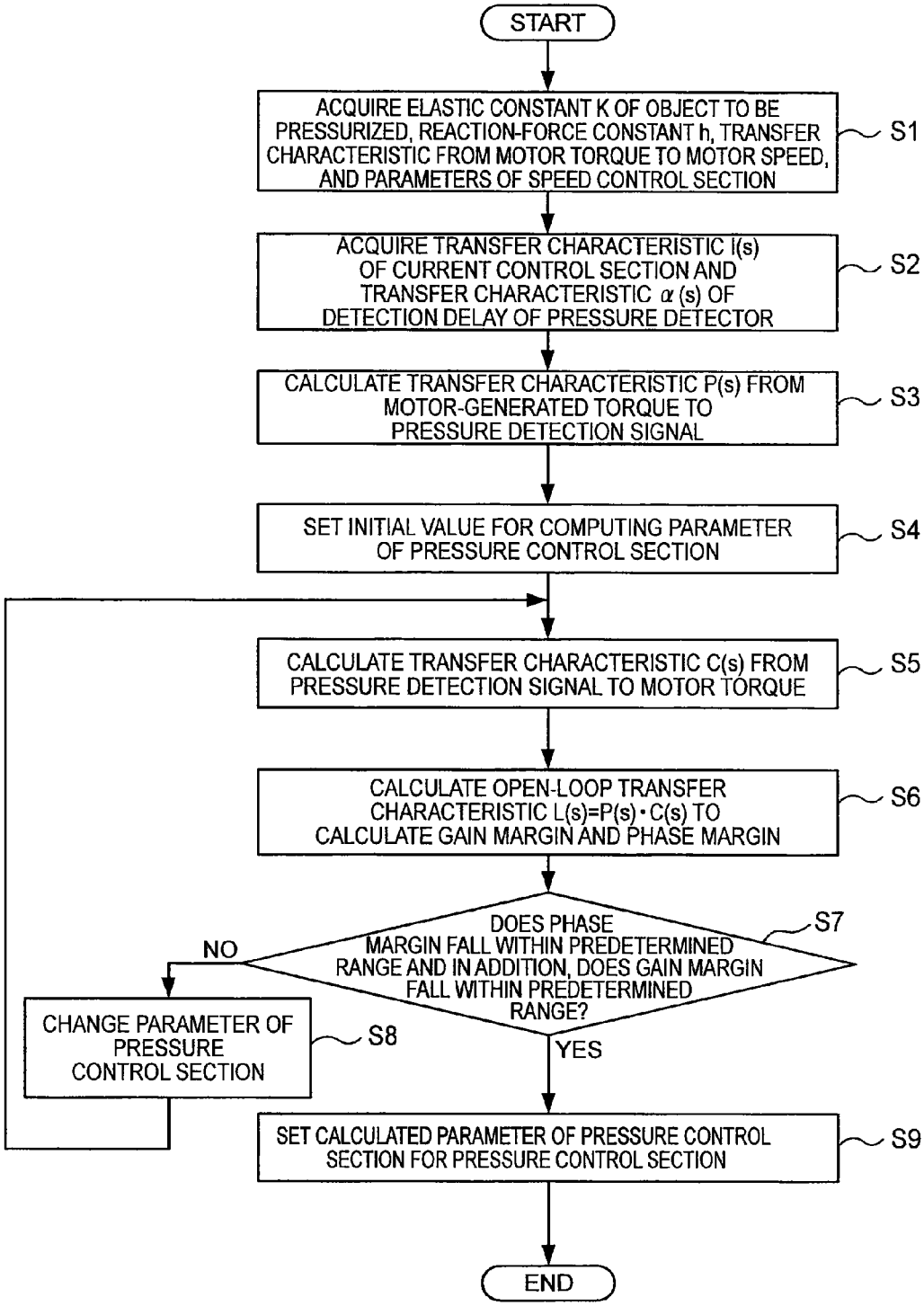
FIG. 5 A flowchart illustrating an operation of the parameter-adjusting section illustrated in FIG. 1.

Next, an operation performed when the parameter-adjusting section 100 illustrated in FIGS. 3 and 4 adjusts the parameter Ka of the pressure control section 12 is described. FIG. 5 is a flowchart illustrating an operation of the parameter-adjusting section 100 illustrated in FIGS. 3 and 4. An operation series illustrated in FIG. 5 is executed at the time of setting of the operation of the processing device 1 (at the time of initial setting or at the time of replacement of the pressurized target 7).

First, in Step S1, the parameter-adjusting section 100 acquires each of the pieces of information including the elastic constant K of the pressurized target 7, the transfer characteristic from the motor torque 20*c* to the motor speed, and the reaction-force constant h which is the reaction-force information of the torque generated with the generation of the pressure. In this case, the elastic constant K can be calculated based on the relationship between the previously measured motor position and the pressure. As an example of the transfer characteristic from the motor torque 20*c* to the motor speed, the mechanical load 5 is regarded as a rigid body as described above and 1/(J·s) is set by using the total inertia J of the mechanically-movable portion.

The total inertia J of the mechanically-movable portion may be calculated from a design value of the machine or may be calculated by previously driving the mechanical load 5 in a non-contact state with the pressurized target 7 and then estimating a mechanical inertia from the motor speed, the motor current, or the like at the time. Note that, the transfer characteristic from the motor torque 20*c* to the motor speed is not limited thereto.

Besides, the transfer characteristic from the motor torque 20*c* containing the mechanical resonance expressed by Expression (2) to the motor speed may be previously calculated from the motor-speed detection signal 3*a* obtained when a sine wave or an M-series signal is applied as the torque command in a state in which the mechanical load 5 is not held in contact with the pressurized target 7 so that the calculated transfer characteristic is used. The constant h indicating the reaction force is obtained from the lead p of the feed-screw mechanism (ball screw) as $h=p/(2\pi)$ as described above (when the gear ratio is 1/N, $h=N\times p/(2\pi)$.) The case where 1/(J·s) is used as the transfer characteristic from the motor torque 20*c* to the motor speed is described below.

In Step S1, the parameter-adjusting section 100 acquires the transfer characteristic of the speed control section 13 and information of the parameters thereof. The transfer characteristic is already known at the time of configuring the control and therefore, the information thereof may be directly used.

In Step S2, the parameter-adjusting section 100 acquires the transfer characteristic I(s) of the current control section 14. As the transfer characteristic I(s) of the current control section 14, for example, there is given a transfer characteristic in a frequency region, which is previously non-parametrically calculated by a sine-wave sweep method for issuing a current command in a state in which a pressure control loop and a speed control loop are not formed, that is, a feedback loop is not applied and then analyzing a current output at the time, or the like.

Note that, the transfer characteristic of the current control section 14 is not limited thereto. The current control section 14 may be approximated with a low-pass characteristic 1/(Ts+1) by using a given time constant T. Alternatively, the parameter-adjusting section 100 may parametrically obtain the transfer characteristic as a dead-time characteristic exp(−T1·s) or the like by using a dead time T1. When the current control section 14 has a sufficiently high responsiveness, I(s)=1 may be set.

When the detection delay characteristic of the pressure detector 6 is non-negligibly large, the parameter-adjusting section 100 acquires the information of the detection delay characteristic. When the pressure detector 6 is a load cell, α(s) may be acquired based on a response frequency range of the load cell or a sampling time corresponding to a D/A output cycle. Further, when the detection delay characteristic of the pressure detector 6 is sufficiently small, α(s)=1 may be set.

In Step S3, the parameter-adjusting section 100 calculates a transfer characteristic P(s) from the motor-generated torque 20*a* illustrated in FIG. 2 to the pressure detection signal 6*a*. In this case, from the block diagram of FIG. 2, a transfer characteristic as expressed by the following Expression (3) is established.

[Math. 3]

$$P(s) = \frac{\frac{1}{Js}\cdot\frac{K}{s}}{1+h\cdot\frac{1}{Js}\cdot\frac{K}{s}}\alpha(s) = \frac{K}{Js^2+h\cdot K}\alpha(s) \tag{3}$$

In order to obtain the transfer characteristic from the motor-generated torque 20*a* to the pressure detection signal 6*a*, there is conceived a method of applying the M-series signal or the sine-wave signal as the motor torque in a state in which the mechanical load 5 is held in contact with the pressurized target 7 so that the transfer characteristic is identified based on the torque command signal 13*a* applied as an input at this time and the pressure detection signal 6*a* obtained as an output at this time. However, when the torque command signal 13*a* such as the M-series signal or the sine-wave signal, with which a time average becomes approximately zero, is applied as the motor torque, the mechanical load 5 comes into contact with or is separated away from the pressurized target 7. Therefore, a precise characteristic cannot be obtained.

As described above, by the calculation from the transfer characteristic from the motor torque 20*c* to the motor speed, the information regarding the reaction force, and the elastic contact of the pressurized target 7, the precise transfer characteristic from the torque-command signal 13*a* to the pressure detection signal 6*a*, which serves as the basis of calculation of the parameter of the pressure control section 12, can be obtained.

In Step S4, the parameter-adjusting section 100 sets an initial value for computing the parameter Ka of the pressure control section 12. In this case, the setting of the initial value does not mean the setting of the initial value in the pressure control section 12 but means the setting of a temporary initial value for performing processing in Steps S5 to S8 described below in the parameter-calculating section 102.

In Step S5, the parameter-adjusting section 100 takes advantage of the fact that the transfer characteristic from the pressure detection signal 6*a* to the motor speed is a transfer characteristic containing a differential characteristic having a reciprocal of the elastic constant of the pressurized target 7, thereby calculating a transfer characteristic C(s) from the pressure detection signal 6*a* to the motor-generated torque 20*a*. As can be seen from FIG. 2, the motor-generated torque 20*a* is determined depending not only on the pressure detection value of the pressure detection signal 6*a* but also on the motor-speed detection value of the motor-speed detection signal 3*a*. When the motor-speed detection value of the motor-speed detection signal 3*a* is v(s), the pressure detection value of the pressure detection signal 6*a* is F(s), and the motor-generated torque 20*a* is τ(s), a transfer characteristic from v(s) and F(s) to τ(s) can be expressed as the following Formula (4).

[Math. 4]

$$\tau(s) = -K_v\left(1 + \frac{K_{vi}}{s}\right) \cdot I(s) \cdot (K_a F(s) + v(s)) \tag{4}$$

In this case, a factor $K_v(1+K_{vi}/s)$ in Expression (4) is derived from the fact that the speed control section 13 performs the proportional and integral control.

When the transfer characteristic of the pressure detector 6 is negligibly small, that is, α(s)=1, the motor position and the pressure detection value have the proportional relationship and therefore, the motor position is a value obtained by integrating the motor-speed detection value. Accordingly, the motor-speed detection value v(s) and the pressure detection value F(s) have the relationship expressed by the following Expression (5).

[Math. 5]

$$F(s) = \frac{K}{s} v(s) \tag{5}$$

By using the relationship expressed by Expression (5) in the other way, the relationship expressed by the following Expression (6) can be obtained.

[Math. 6]

$$v(s) = \frac{s}{K} F(s) \tag{6}$$

In this case, s indicates a differential characteristic in terms of the transfer characteristic, which corresponds to the fact that the transfer characteristic from the pressure detection signal 6*a* to the motor-speed detection signal 3*a* contains the differential characteristic having the elastic constant as the reciprocal. When the delay characteristic α(s) of the pressure detector 6 is not negligible, the following Expression (7) is established.

[Math. 7]

$$F(s) = \frac{K}{s} \alpha(s) \cdot v(s) \tag{7}$$

By using the relationship expressed by Expression (7) in the other way, the relationship expressed by the following Expression (8) can be obtained.

[Math. 8]

$$v(s) = \frac{s}{K} \frac{1}{\alpha(s)} \cdot F(s) \tag{8}$$

Specifically, even when the pressure detector 6 has the detection delay characteristic, the relationship that the transfer characteristic from the pressure detection signal 6*a* to the motor speed contains the differential characteristic having the reciprocal of the elastic constant as the proportionality constant is established.

Hereinafter, the case where the delay characteristic is negligible for the pressure detector 6, that is, α(s)=1 is satisfied is described. By substituting Expression (6) expressing the relationship between the motor-speed detection value of the motor-speed detection signal 3*a* and the pressure detection value of the pressure detection signal 6*a* into Expression (4), the following Expression (9) is obtained.

[Math. 9]

$$\tau(s) = K_V\left(K_a + \frac{s}{K}\right)\left(1 + \frac{K_{vi}}{s}\right) I(s) \cdot F(s) \tag{9}$$

The transfer characteristic C(s) from the pressure detection value F(s) to the motor-generated torque τ(s) is expressed by the following Expression (10).

[Math. 10]

$$C(s) = \left(K_a + \frac{s}{K}\right) K_v\left(1 + \frac{K_{vi}}{s}\right) I(s) \tag{10}$$

By using Expression (6) or (8), when a configuration in which the speed control is provided as a minor loop of the pressure control is used, the motor-generated torque τ(s) depending on the motor-speed detection value v(s) and the pressure detection value F(s) as expressed by Expression (4) can be expressed in a form in which the motor-generated torque depends only on the pressure detection value F(s).

Next, in Step S6, the parameter-adjusting section 100 calculates an open-loop transfer characteristic L(s)=P(s)·C(s) values based on Steps S1 to S5 to calculate a gain margin and a phase margin of the open-loop transfer characteristic.

Next, in Step S7, the parameter-adjusting section 100 verifies whether or not both the gain margin and the phase margin of the open-loop transfer characteristic are in the predetermine ranges, respectively. When each of the gain margin and the phase margin becomes smaller than zero, the pressure control becomes unstable. Therefore, by providing some margin to each of the margins, the gain margin set to 5 dB to 40 dB and the phase margin set to 5 to 50 degrees or the like can be given as an example of the predetermined ranges.

When at least any one of the gain margin and the phase margin does not fall within the corresponding predetermined range in Step S7, the parameter-adjusting section 100 changes the parameter Ka of the pressure control section 12 and repeatedly executes the processing in Steps S5 to S7 again. In this case, as a way to change the parameter of the pressure control section 12, Ka is increased when at least any one of the gain margin and the phase margin is larger than the corresponding predetermined range, whereas Ka is reduced when at least any one of the gain margin and the phase margin is smaller than the corresponding predetermined range.

On the other hand, when the gain margin and the phase margin both fall within the predetermined ranges in Step S7, the parameter-adjusting section 100 proceeds to Step S9 to perform processing. In Step S9, the parameter of the pressure control section 12, which is obtained by the preceding processing, is set for the pressure control section 12. Then, the parameter-adjusting section 100 ends the operation series.

Next, the effectiveness of the motor control device according to the first embodiment is described by a simulation. In this simulation, the parameter of the pressure control section 12 was calculated under the conditions described below. The transfer characteristic from the motor torque 20*c* to the motor speed is expressed by Expression (1), and J=1.0e-3 [kg·m$^2$] is set. Moreover, the simulation was performed with the reaction-force constant set as h=3.18e-3 [N·m/N], the elastic constant set as K=1.44e+4 [N/rad], the transfer characteristic of the current control section 14 set as I(s)=exp(−0.003 s), the delay characteristic of the pressure detector 6 being regarded as negligible, and $\alpha(s)=1$.

As the configuration of the pressure control, the control includes the speed control as the minor loop of the pressure control as illustrated in FIGS. 1 and 2. The pressure control section 12 is configured by the proportional control (the parameter of the pressure control section 12 is Ka which is the proportional gain), whereas the speed control section 13 is configured by the proportional and integral control section (the parameters of the speed control section 13 are the proportional gain Kv and the integral gain Kvi). The parameters of the speed control section 13 are Kv=0.1 [(N·m)/(rad/s)] and Kvi=3.33 [rad/s].

The parameter Ka of the pressure control section 12 was calculated in accordance with the flowchart illustrated in FIG. 5 so that the gain margin became equal to or larger than 5 dB and equal to or smaller than 5.5 dB and the phase margin became equal to or larger than 5 degrees, and then the pressure proportional gain Ka, which is the parameter of the pressure control section 12, was adjusted to 0.0115 [(rad/s)/N].

Figure 6:
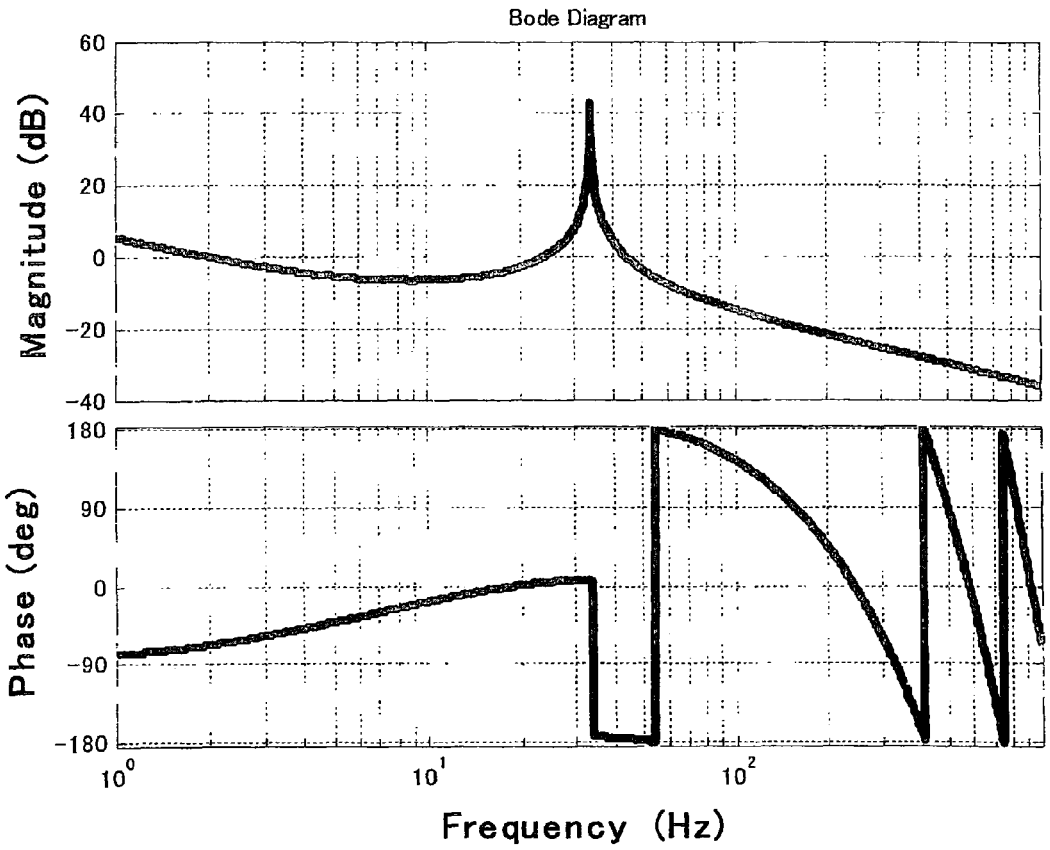
FIG. 6 A Bode diagram showing an open-loop transfer characteristic when a parameter of a pressure control section, which is calculated in accordance with the flowchart of FIG. 5, is adopted.

FIG. 6 is a Bode diagram showing an open-loop transfer characteristic L(s)=P(s)·C(s) when the proportional gain Ka, which is the parameter of the pressure control section 12 and calculated in accordance with the flowchart of FIG. 5, is set to 0.0115 [(rad/s)/N]. According to the gain characteristic of FIG. 6, it is understood that the gain characteristic has a large peak in the vicinity of 34 Hz. The peak characteristic is due to P(s) and a frequency thereof is determined by $\sqrt{(K \cdot h/J)}$.

As in the first embodiment, the parameter-adjusting section 100 adjusts the parameter of the pressure control section 12. As a result, the parameter of the pressure control section 12 can be set in consideration of the elastic constant K, the reaction-force constant h, and the peak characteristic determined by J which is the information of the transfer characteristic from the motor torque 20*c* to the motor speed.

Figure 7:
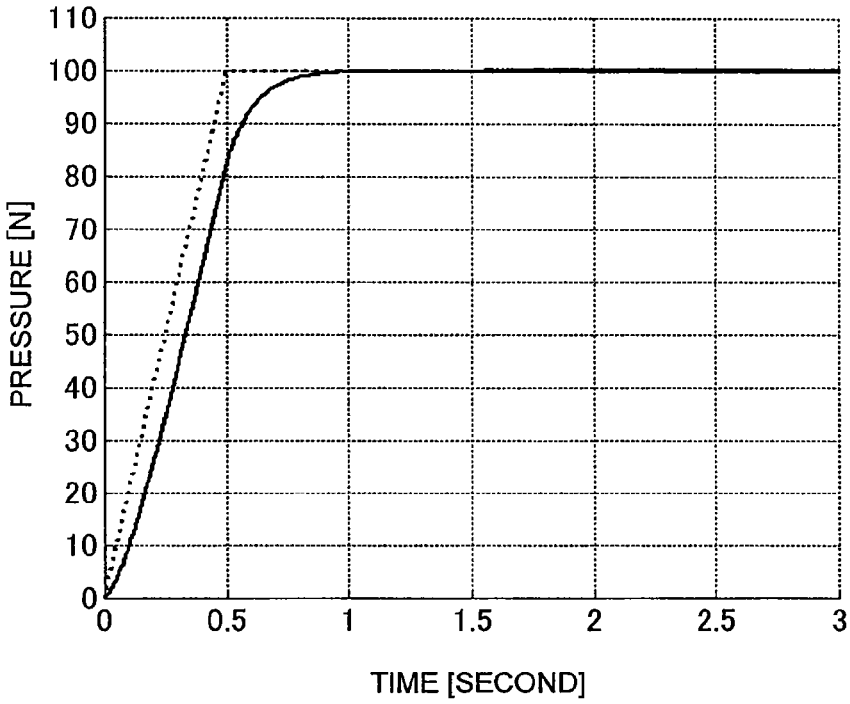
FIG. 7 A graph showing a time response of a pressure detection signal when the parameter of the pressure control section, which is calculated in accordance with the flowchart of FIG. 5, is adopted.

FIG. 7 is a graph showing a time response of the pressure detection signal 6*a* when the parameter of the pressure control section 12, which is calculated in accordance with the flowchart of FIG. 5, is adopted. FIG. 7 shows the result of a simulation of the pressure detection signal 6*a* when the pressure command signal 11*a*, which increases from 0 [N] to 100 [N] over 0.5 [seconds] in a ramping manner and is maintained to 100 [N] after 0.5 [seconds], is applied as the pressure command signal while the pressure proportional gain is set to Ka=0.0115 [(rad/s)/N] and further, the parameters of the speed control section 13 are set as Kv=0.1 [(N·m)/(rad/s)] and Kvi=3.33 [rad/s].

In FIG. 7, the pressure command signal 11*a* is indicated by a dotted line, whereas the pressure detection signal 6*a* is indicated by a solid line. According to FIG. 7, overshoot, in which the value of the pressure detection signal 6*a* becomes larger than the value of the pressure command signal 11*a*, and vibrations in the pressure detection signal 6*a* itself do not occur. Therefore, it is verified that good pressure control is realized. Such a good characteristic is realized because the parameter of the pressure control section 12 is determined based on the respective pieces of information including the values of the parameters Kv and Kvi of the speed control section 13 which is the minor loop, the elastic constant K of the pressurized target 7, the reaction-force constant h which is the reaction-force information, and the transfer characteristic from the motor torque 20*c* to the motor speed.

Next, the simulation was performed after the conditions, under which the simulation illustrated in FIG. 7 was performed, were changed so that the speed proportional gain Kv was changed from Kv=0.1 [(N·m)/(rad/s)] to Kv=0.15 [(N·m)/(rad/s)] and the speed integral gain was changed from Kvi=3.33 [rad/s] to Kvi=50 [rad/s] while the proportional gain Ka, which is the parameter of the pressure control section 12, was kept to 0.0115 [(rad/s)/N]. This simulation corresponds to a simulation of the pressure control in which the pressure control parameter which is not based on the present invention is calculated. As the pressure command signal 11*a*, the same pressure command signal as that illustrated in FIG. 7 was applied. The result of the simulation is shown in FIG. 8.

Figure 8:
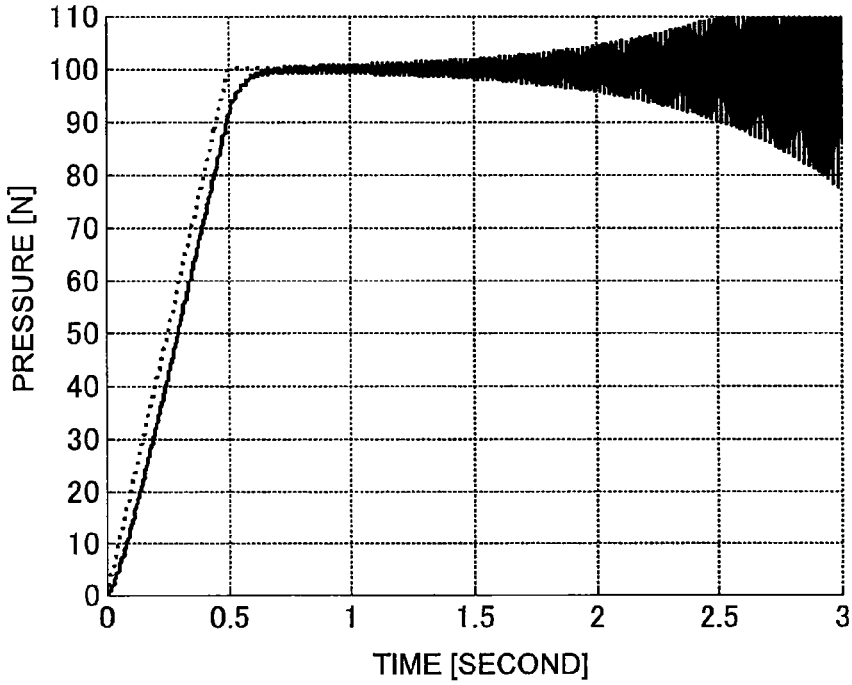
FIG. 8 A graph showing a time response of the pressure detection signal when the parameter of the pressure control section, which is calculated in accordance with the flowchart of FIG. 5, is not adopted.

Even in FIG. 8, the pressure command signal 11*a* is indicated by a dotted line, whereas the pressure detection signal 6*a* is indicated by a solid line. According to FIG. 8, it is understood that vibrations at a high frequency are generated in the pressure command signal 11*a* and in addition, the pressure command signal 11*a* diverges with elapse of time to exhibit an unstable behavior. This unstable behavior occurs with the changes in the speed proportional gain and the speed integral gain which are the parameters of the speed control section 13 which is the minor loop.

In the simulations shown in FIGS. 7 and 8, the elastic constant K of the pressurized target 7 and the parameter Ka of the pressure control section 12 are the same. Although good pressure control is realized in one of the simulations, the pressure control in the other simulation is not good. This shows that the parameter of the pressure control section 12 is required to be set in accordance with the parameters of the speed control section 13 which is the minor loop.

Next, with the speed proportional gain Kv=0.15 [(N·m)/(rad/s)] and the speed integral gain Kvi=50 [rad/s] which are the parameters of the speed control section 13, a simulation for calculating the parameter of the pressure control section 12 was performed again in accordance with the flowchart of FIG. 5. The conditions are the same as those under which the simulation shown in FIG. 7 was performed, except for the parameters of the speed control section 13. As the result of the simulation, the proportional gain Ka, which is the parameter of the pressure control section 12, was calculated as 0.0069 [(rad/s)N]. A time response waveform obtained by simulating the pressure detection signal 6*a* when the above-mentioned numerical value was set as the parameter of the pressure control section 12 is shown in FIG. 9.

Figure 9:
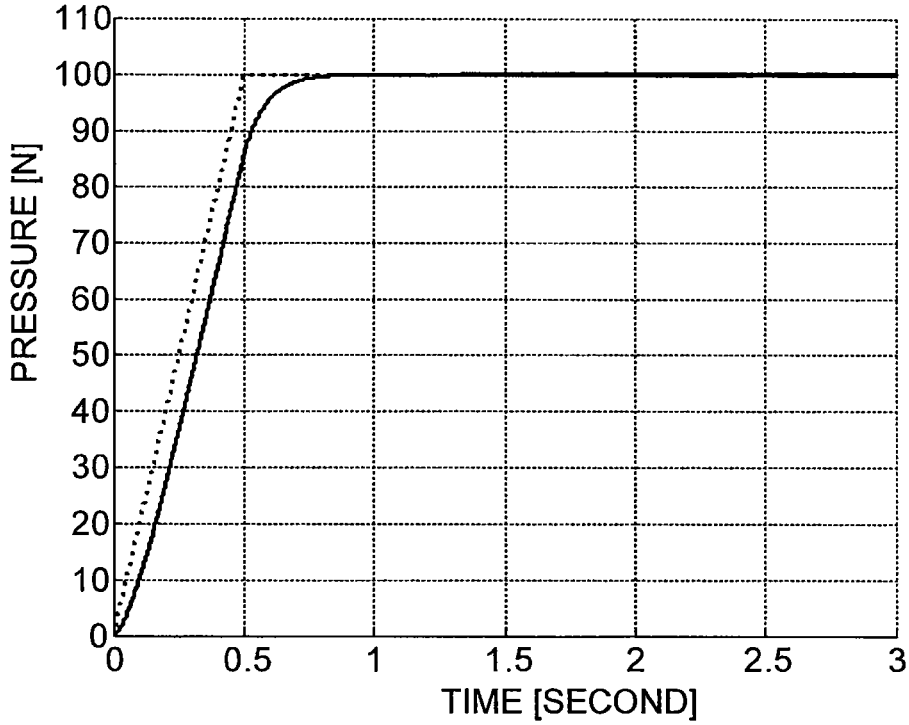
FIG. 9 A graph showing the time response of the pressure detection signal when the parameter of the pressure control section, which is calculated in accordance with the flowchart of FIG. 5, is adopted.

Even in FIG. 9, the pressure command signal 11*a* is indicated by a dotted line, whereas the pressure detection signal 6*a* is indicated by a solid line. According to FIG. 9, as in the case of FIG. 7, it is verified that undesirable phenomena such as overshoot and vibrations do not occur and hence, good pressure control is realized. This is because appropriate pressure control is realized by taking the transfer characteristic from the motor torque 20*c* to the motor speed, the elastic constant of the pressurized target 7, the information regarding the reaction force, and the parameters of the speed control section 13 which is the minor loop into consideration, as in the case of FIG. 7.

Next, the effects of setting the parameter of the pressure control section 12, which is calculated in accordance with the flowchart of FIG. 5, are described. In the motor control device according to the first embodiment, the parameter-adjusting section 100 uses not only the elastic constant of the pressurized target 7 but also each of the pieces of information including the information of the reaction force transmitted from the actual pressure 8*a* to the motor torque 20*c* and the transfer characteristic from the motor torque 20*c* to the motor speed to adjust the parameter of the pressure control section 12. Therefore, a precise transfer characteristic from the motor-generated torque 20*a* to the pressure can be calculated. As a result, control performance can be improved while stability of the control system is ensured. The information of the reaction force from the actual pressure 8*a* to the motor torque 20*c* is not required when the position or the speed of the motor 2 is controlled and is required only when the pressure control is performed.

The computation method of the first embodiment uses the transfer characteristic from the motor-generated torque 20*a* to the pressure detection signal 6*a*, which includes the pressurized target 7. If the transfer characteristic is to be identified from an output signal (pressure signal) obtained when the M-series signal or the sine sweep is applied to the input signal (torque) so as to obtain the transfer characteristic, which is a general method for identifying the transfer characteristic, the mechanical load comes into contact with and is separated away from the pressurized target 7. Therefore, the transfer characteristic cannot be precisely obtained. On the other hand, with the method according to the first embodiment, the transfer characteristic can be precisely obtained. Thus, the parameter of the pressure control section 12 can be appropriately adjusted based on the transfer characteristic.

The stability of the pressure control in terms of control is determined depending not only on the parameter of the pressure control section 12 but also on the gain parameters of the speed control which is the minor loop. According to the first embodiment, the configuration of the controller of the minor loop is reflected in C(s) which is the transfer characteristic from the pressure command signal 11*a* to the motor torque 20*c* so that the parameter of the pressure control section 12 is set based on the configuration of the speed control which is the minor loop and the parameters thereof. Therefore, the appropriate parameter of the pressure control section 12 can be calculated. As a result, in the first embodiment, the control performance can be improved while the stability of the control system is ensured.

In the first embodiment, the transfer characteristic from the motor torque 20*c* to the motor speed is used. Instead, however, the transfer characteristic from the motor torque 20*c* to the motor position or the transfer characteristic from the motor torque 20*c* to a motor acceleration may be used. As an example of the case where the transfer characteristic from the motor torque 20*c* to the motor position is used, the use of the following Expression (11) using the total inertia J of the mechanically-movable portion is given.

[Math. 11]

$$\frac{1}{Js^2} \tag{11}$$

The expression is not limited thereto. The following Expression (12), which is a transfer characteristic expressing a resonance element of the machine as in the case of Expression (2), may be used instead.

[Math. 12]

$$\frac{1}{Js^2}\prod_{i=1}^{n}\frac{1+2(\zeta_{zi}/\omega_{zi})s+(s/\omega_{zi})^2}{1+2(\zeta_{ai}/\omega_{ai})s+(s/\omega_{ai})^2} \tag{12}$$

Figure 10:
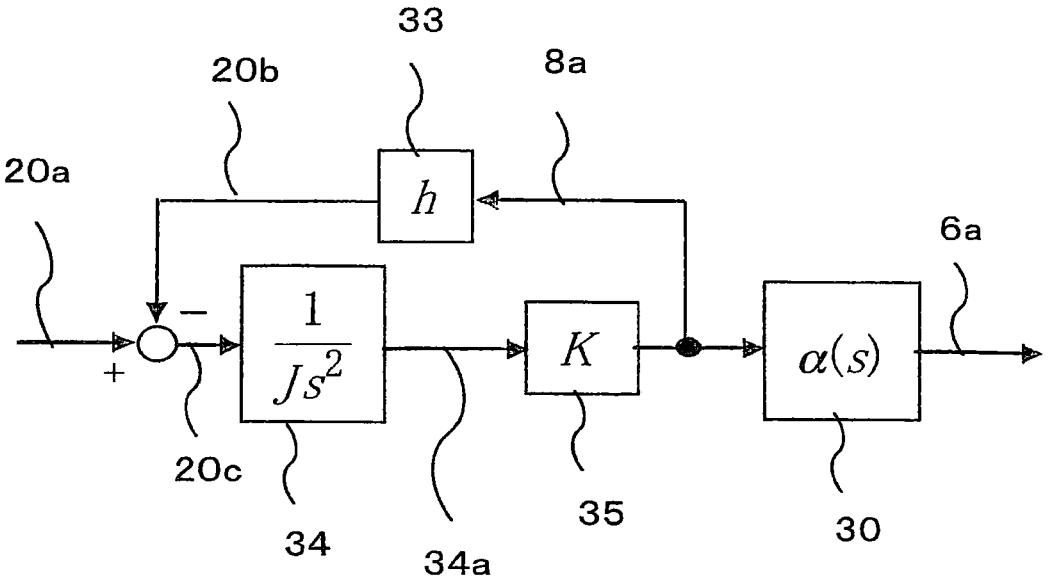
FIG. 10 A block diagram illustrating a transfer characteristic from a motor-generated torque to the pressure detection signal.

The relationship between the pressure detection signal 6*a*, the motor-generated torque 20*a*, the motor torque 20*c*, and the reaction-force torque 20*b* illustrated in FIG. 5, which is depicted by using the transfer characteristic from the motor torque 20*c* to the motor position, is illustrated in FIG. 10. In FIG. 10, reference symbol 34 denotes a block indicating the transfer characteristic from the motor torque 20*c* to the motor position, reference symbol 34*a* denotes a signal indicating the motor position, and reference symbol 35 denotes a proportionality characteristic indicated by the elastic constant of the pressurized target 7, which indicates the transfer characteristic from the motor-position signal 34*a* to the pressure detection signal 6*a*.

Even in FIG. 10, the transfer characteristic P(s) from the motor-generated torque 20*a* to the pressure detection signal 6*a* is expressed by the same expression as Expression (3). Therefore, even when the transfer characteristic from the motor torque 20*c* to the motor position is used in place of the transfer characteristic from the motor torque 20*c* to the motor speed, the same result is obtained. This is because the elastic constant of the pressurized target 7, which indicates a rate of increase in the pressure with respect to the motor position, is used. Similarly, the transfer characteristic from the motor torque 20*c* to the motor acceleration may be used in place of the transfer characteristic from the motor torque 20*c* to the motor speed or the transfer characteristic from the motor torque 20*c* to the motor position.

Further, referring to the flowchart of FIG. 5, the processing for calculating the gain margin and the phase margin of the open-loop characteristic and adjusting the parameter of the pressure control section 12 so that the gain margin and the phase margin fall within the predetermined ranges has been described. However, the method of adjusting the parameter of the pressure control is not limited thereto. For example, even when the parameter of the pressure control is determined from the transfer characteristic P(s) expressed by Expression (3) and the transfer characteristic C(s) expressed by Expression (10) so that a closed-loop transfer function P(s)·C(s)/(1+P(s)·C(s)) from the pressure command signal to the pressure detection signal falls within a range specified by the closed-loop transfer function without causing micro-vibrations or instability, the parameter of the pressure control section 12 can be adjusted so that each of the pieces of information including the elastic constant of the pressurized target 7, the torque generated with the generation of the reaction force, the transfer characteristic from the motor torque 20*c* to the motor speed or the motor position, the control law of the speed control section 13, and the parameters of the speed control section 13 is reflected therein.

In the description given above, the example in which the rotary motor is used as the motor 2 has been described. However, even when a linear motor is used as the motor 2, the present invention can be applied almost in the same manner. When the linear motor is used as the motor 2, a thrust corresponds to the torque and a total mass of the mechanically-movable portion corresponds to the total inertia of the mechanically-movable portion. Further, a screw-feed mechanism is not used so that the linear motor directly drives the mechanical load and is directly subjected to the reaction force. Therefore, the configuration using the linear motor differs from the configuration using the rotary motor in that the reaction-force constant relating to the reaction force is h=1.

Second Embodiment

In the first embodiment, the case where the speed control is provided as the minor loop of the pressure control has been described. On the other hand, even in the case where position control is provided as the minor loop, that is, the pressure control section 12 outputs a signal having a dimension of position such as a position command signal, the control can be performed in the same manner as in the first embodiment. Therefore, the case where the position control is provided as the minor loop described above is described in a second embodiment.

Figure 11:
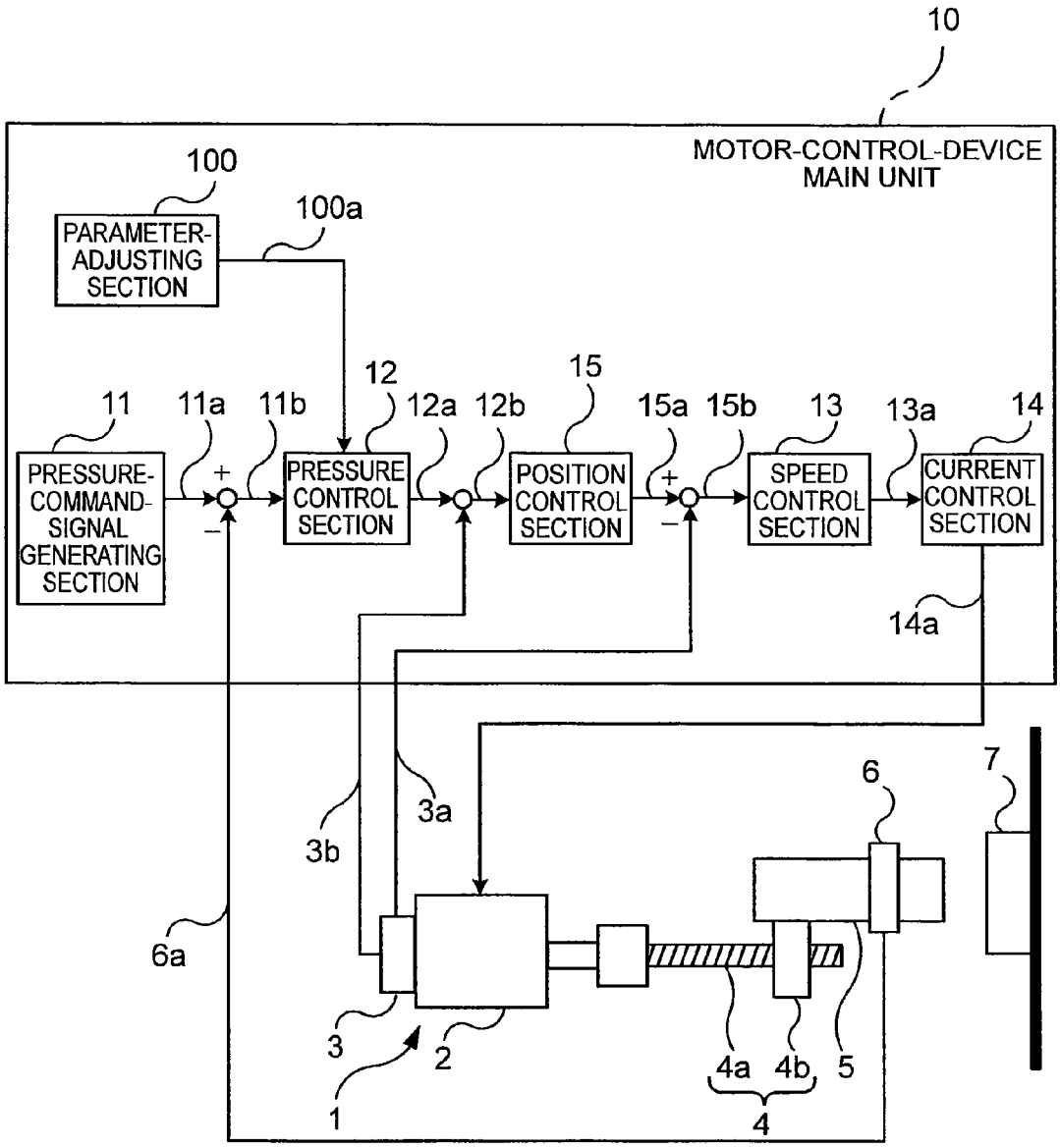
FIG. 11 A block diagram illustrating a motor control device according to a second embodiment of the present invention.

FIG. 11 is a block diagram illustrating a motor control device according to the second embodiment. In FIG. 11, a configuration of a motor-control-device main unit 10 of the second embodiment is the same as that of the motor-control-device main unit 10 of the first embodiment except that a position control section 15 is further provided and a parameter-adjusting section 100 uses information regarding the position control. An encoder 3 of the second embodiment differs from the encoder 3 in that a motor-position detection signal 3*b* in accordance with a motor position is further generated. Specifically, the encoder 3 of the second embodiment constitutes both position detecting means and speed detecting means. Here, differences from the first embodiment are mainly described.

A pressure control section 12 of the second embodiment performs a pressure control computation based on a signal of a deviation (difference) between the value of the pressure command signal 11*a* and the value of the pressure detection signal 6*a* so that the value of the pressure detection signal 6*a* becomes equal to the value of the pressure command signal 11*a*, thereby calculating a position command value so as to generate a position command signal 12*c* which is a signal thereof. As specific examples of the pressure control computation, proportional control for multiplying the deviation between the value of the pressure command signal 11*a* and the value of the pressure detection signal 6*a* by the proportionality constant, the integral control for integrating the deviation and then multiplying the result by the proportionality constant, and the like are given. However, proportional and integral control, phase delay/advance compensation, and the like may be used.

The position control section 15 receives a signal 12*d* of a deviation between the position command value of the position command signal 12*c* and a position detection value of the motor-position detection signal 3*b* output by the encoder 3 and performs the position control computation based on the deviation to calculate the speed command signal, thereby generating a speed command value 15*a* thereof. As a specific example of the position control computation, proportional control for multiplying the deviation by a position gain to calculate the speed command value and the like is given. A speed control section 13 of the second embodiment performs the speed control computation based on the deviation between the speed command value of the speed command signal 15*a* and the motor-speed detection value of the motor-speed detection signal 3*a* to calculate the torque command value so as to generate the torque command signal 13*a* thereof.

A parameter-adjusting section 100 of the second embodiment adjusts the parameter of the pressure control section 13 based on each of the pieces of information including the elastic constant of the pressurized target 7, information regarding the reaction force, the transfer characteristic from the motor torque 20*c* to the motor speed, the control law and the parameters of the speed control section 13, and a control law and a parameter of the position control section 15.

Figure 12:
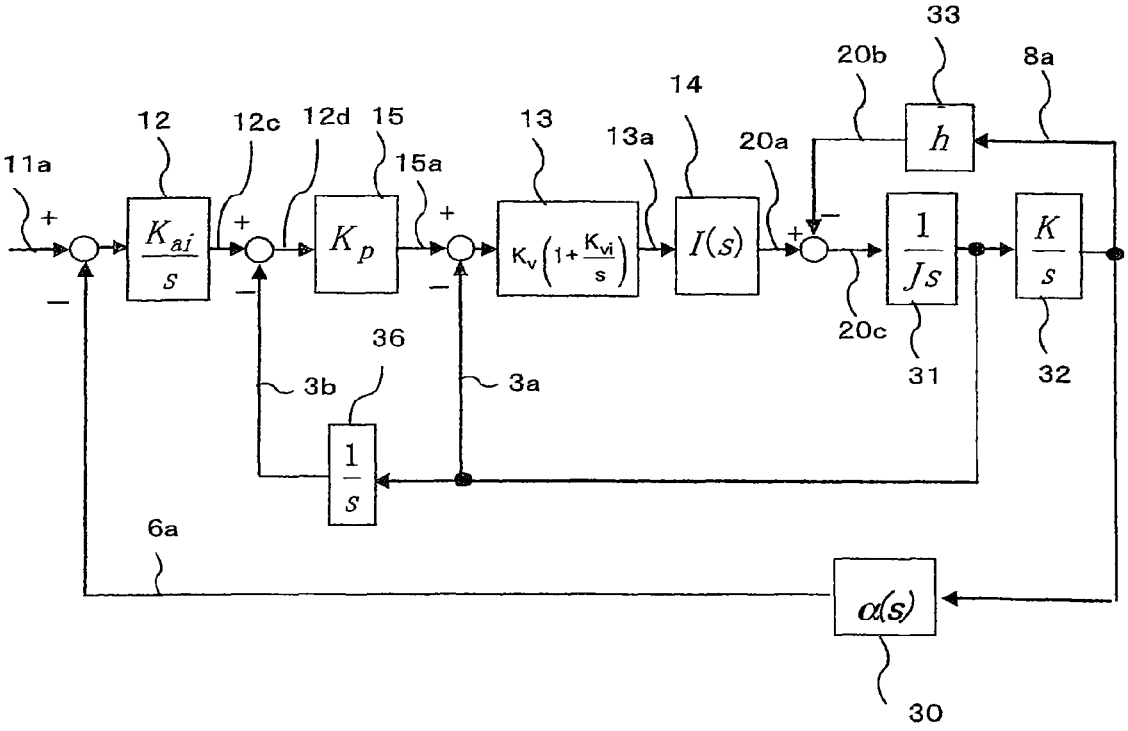
FIG. 12 A block diagram illustrating a transfer characteristic of a signal illustrated in FIG. 11.

FIG. 12 is a block diagram illustrating transfer characteristics of the signals illustrated in FIG. 11. FIG. 12 illustrates the transfer characteristics of the respective functional blocks illustrated in FIG. 11 other than the pressure-command-signal generating section 11, the parameter-adjusting section 100, and the parameter information 100*a*. In FIG. 12, the blocks and signals denoted by the same reference symbols as those illustrated in FIGS. 2 and 11 have the same meanings as those in FIGS. 2 and 11.

FIG. 12 illustrates the case where the integral control (a transfer characteristic of the pressure control section 12 is Kai/s and Kai is a parameter of the pressure control section 12, which is to be adjusted) is used as the pressure control computation of the pressure control section 12, the proportional control (a transfer characteristic of the position control section 15 is Kp and Kp is a parameter of the position control section 15) is used as the position control computation of the position control section 15, and the proportion and integral control is used as the speed control computation of the speed control section 13 as in the case of FIG. 2. The reference symbol 36 of FIG. 12 denotes a block indicating an integral characteristic 1/s. By using the integral characteristic, the position detection value of the motor-position detection signal 3*b* can be expressed as a value obtained by integrating the motor-speed detection value of the motor-speed detection signal 3*a*.

Figure 13:
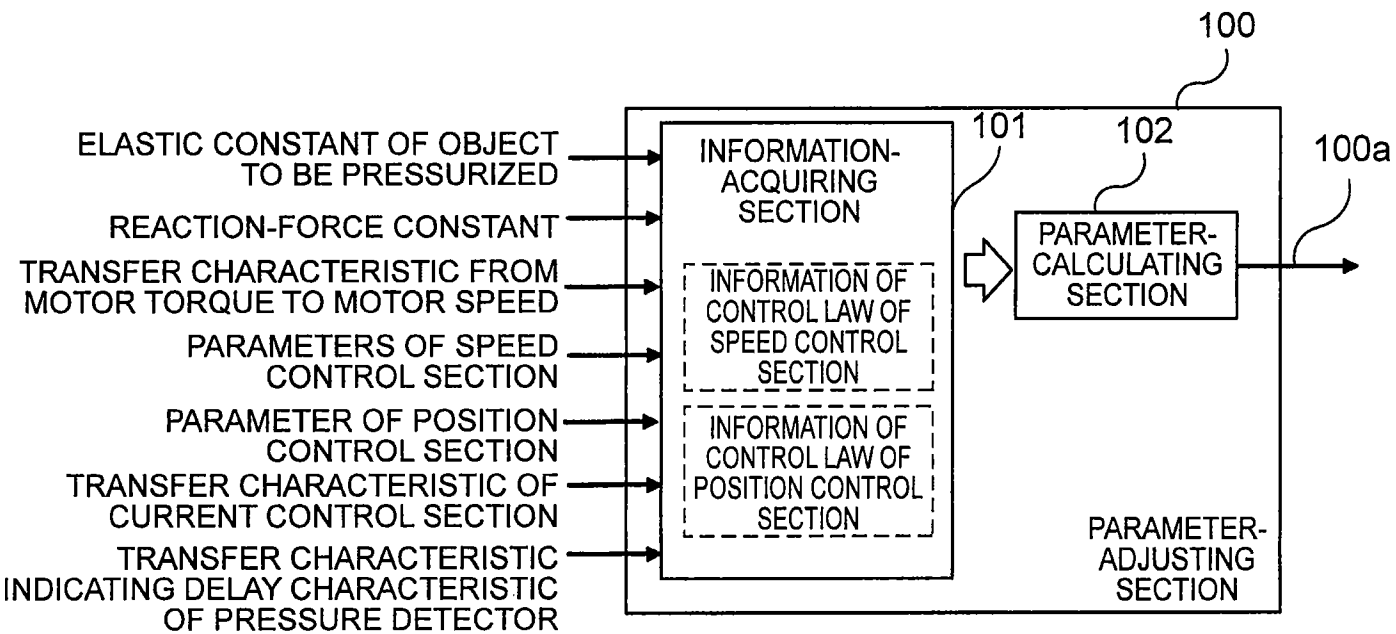
FIG. 13 A block diagram more specifically illustrating a parameter-adjusting section illustrated in FIG. 11.

FIG. 13 is a block diagram more specifically illustrating the parameter-adjusting section 100 illustrated in FIG. 11. An information-acquiring section 101 of the second embodiment acquires, from the exterior, each of the pieces of information including the elastic constant K of the pressurized target 7, the reaction-force constant h indicating the information of the reaction force, the transfer characteristic from the motor torque 20*c* to the motor speed, as is represented by Expressions (1) and (2) described above, the parameters Kv and Kvi of the speed control section 13, the parameter Kp of the position control section 15, the transfer characteristic I(s) of the current control section 14, and the transfer characteristic $\alpha(s)$ indicating the delay of the pressure detector 6. Note that, when each piece of the information of the transfer characteristic I(s) of the current control section 14 and the transfer characteristic $\alpha(s)$ indicating the delay of the pressure detector 6 is negligibly small, that is, can be both regarded as 1, the acquisition of the information thereof may be omitted.

The information-acquiring section 101 of the second embodiment previously acquires (stores) the information of the control law of the speed control section 13 (that is, the proportional and integral control in FIG. 12) and the information of the control law of the position control section 15 (that is, the proportional control in FIG. 12). A parameter-calculating section 102 calculates the parameter (Kai in FIG. 12) of the pressure control section 12 based on the information acquired by the information-acquiring section 101.

Figure 14:
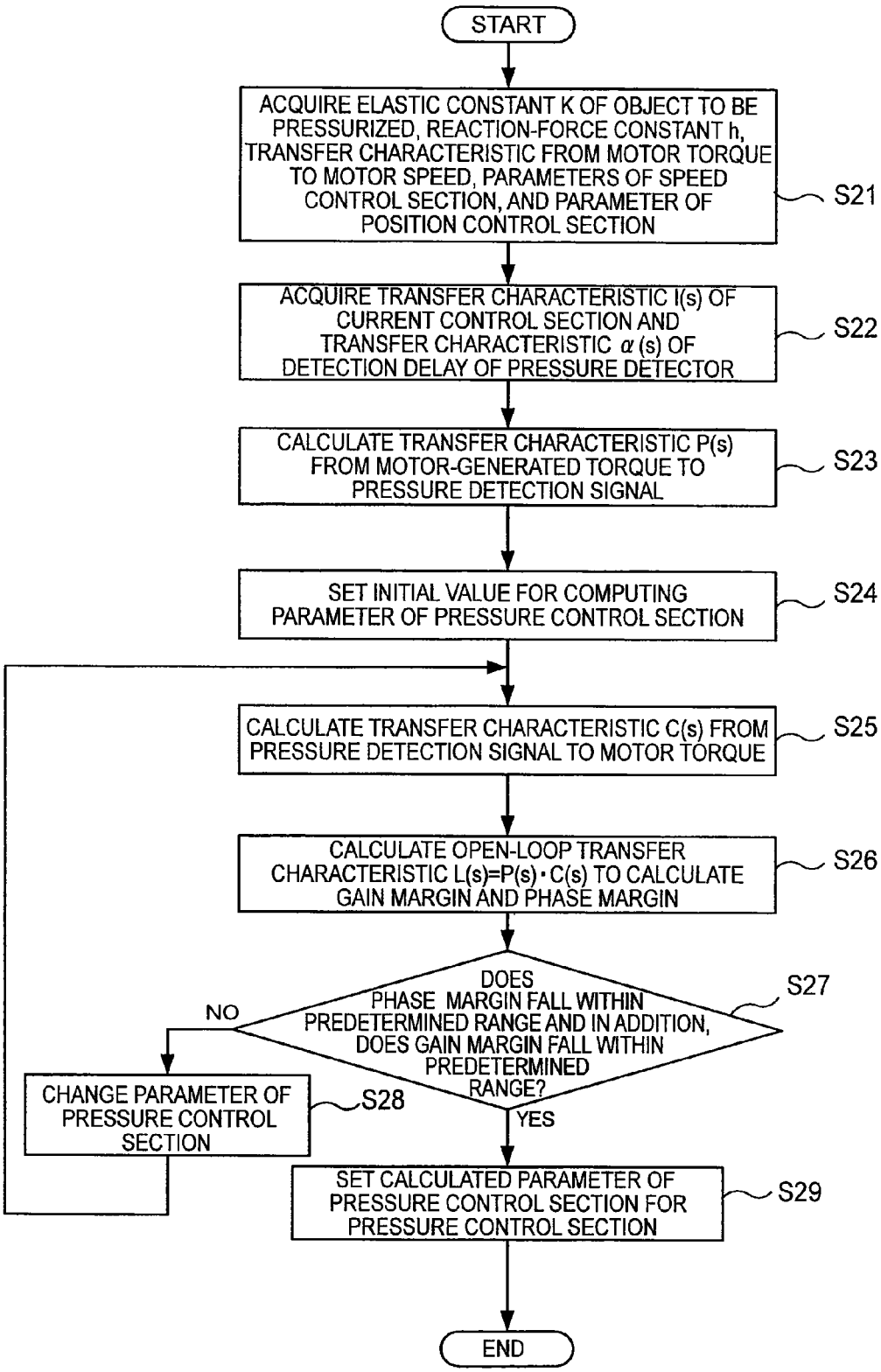
FIG. 14 A flowchart illustrating an operation of the parameter-adjusting section illustrated in FIG. 13.

Next, an operation performed when the parameter-adjusting section 100 illustrated in FIG. 13 adjusts the parameter Kai of the pressure control section 12 is described. FIG. 14 is a flowchart illustrating an operation of the parameter-adjusting section 100 illustrated in FIG. 13. In the following, description is given of a case where the pressure control section 12 performs the integral control, the position control section 15 performs the proportional control, and the speed control section 13 performs the proportional and integral control.

First, in Step S21, the parameter-adjusting section 100 acquires the transfer characteristic from the motor torque 20*c* to the motor speed, the elastic constant K of the pressurized target 7, the reaction-force constant h, the parameters Kv and Kvi of the speed control section 13, and the parameter Kp of the position control section 15. Next, in Step S22, the parameter-adjusting section 100 acquires the transfer characteristic I(s) of the current control section 14 and the transfer characteristic α(s) indicating the delay in detection of the pressure detector 6. Note that, when the delay characteristics of both the transfer characteristics are small, Step S22 may be omitted so that the processing proceeds to Step S23.

In Step S23, the parameter-adjusting section 100 calculates the transfer characteristic P(s) from the motor-generated torque 20*a* to the pressure detection signal 6*a*. Then, in Step S24, the parameter-adjusting section 100 sets an initial value for computing the parameter Kai of the pressure control section 12. The processing performed in Steps S22 to S24 is almost the same as that performed in Steps S2 to S4 illustrated in FIG. 5.

In Step S25, the parameter-adjusting section 100 takes advantage of the fact that the transfer characteristic from the pressure detection signal 6*a* to the motor speed is a transfer characteristic containing a differential characteristic having the reciprocal of the elastic constant of the pressurized target 7 as the proportionality constant, thereby calculating the transfer characteristic C(s) from the pressure detection signal 6*a* to the motor-generated torque 20*a*. When the pressure control section 12 performs the integral control, the position control section 15 performs the proportional control, and the speed control section 13 performs the proportional and integral control, the transfer characteristic is calculated as follows, specifically. In FIG. 12, by using the pressure detection value F(s) and the motor-speed detection value v(s), the motor-generated torque τ(s) can be expressed as the following Expression (13).

[Math. 13]

$$\tau(s) = -K_v\left(1 + \frac{K_{vi}}{s}\right)I(s)\left\{K_p\left(\frac{K_{ai}}{s}F(s) + \frac{1}{s}v(s)\right) - v(s)\right\} \tag{13}$$

By taking advantage of the fact that the transfer characteristic from the pressure detection signal 6*a* to the motor-speed detection signal 3*a* is expressed by Expression (6), the following Expression (14) is obtained.

[Math. 14]

$$\tau(s) = -K_v\left(1 + \frac{K_{vi}}{s}\right)I(s)\left(\frac{K_pK_{ai}}{s} + \frac{1}{K}s + \frac{K_p}{K}\right)\cdot F(s) \tag{14}$$

Then, for the transfer characteristic C(s) from the pressure detection signal 6*a* to the motor-generated torque 20*a*, the following Expression (15) can be derived.

[Math. 15]

$$C(s) = K_v\left(1 + \frac{K_{vi}}{s}\right)I(s)\left(\frac{K_pK_{ai}}{s} + \frac{1}{K}s + \frac{K_p}{K}\right) \tag{15}$$

Next, in Step S26, the parameter-adjusting section 100 calculates the open-loop transfer characteristic L(s)=P(s)·C(s) based on Steps S21 to S25 and then calculates the gain margin and the phase margin of the open-loop transfer characteristic. Next, in Step S27, the parameter-adjusting section 100 verifies whether or not both the gain margin and the phase margin of the open-loop transfer characteristic fall within the predetermined ranges.

In Step S27, when at least any one of the gain margin and the phase margin does not fall within the corresponding predetermined range, the parameter-adjusting section 100 changes the parameter Kai of the pressure control section 12 in Step S28 to repeatedly execute the processing in Steps S25 to S27 again. As a way to change the parameter of the pressure control section 12, Kai is increased when at least any one of the gain margin and the phase margin is larger than the corresponding predetermined range, whereas Kai is reduced when at least any one of the gain margin and the phase margin is smaller than the corresponding predetermined range.

On the other hand, when both the gain margin and the phase margin fall within the predetermined ranges in Step S27, the processing of the parameter-adjusting section 100 proceeds to Step S29. In Step S29, the parameter of the pressure control section 12, which is obtained by the preceding processing, is set for the pressure control section 12. Then, the parameter-adjusting section 100 ends the operation series.

As described above, in the second embodiment, even when the position control is provided as the minor loop of the pressure control, the parameter of the pressure control section 12 is adjusted based not only on the elastic constant of the pressurized target 7 but also on each of the pieces of information including the information regarding the reaction force, the transfer characteristic from the motor torque 20*c* to the motor speed, the control law and the parameters of the speed control section 13, and the control law and the parameter of the position control section 15. Therefore, a precise transfer characteristic from the motor-generated torque 20*a* to the pressure can be calculated. As a result, the control performance can be improved while the stability of the control system is ensured.

The computation of the second embodiment uses the transfer characteristic from the motor-generated torque 20*a* to the pressure detection signal 6*a*, which includes the pressurized target 7, is used. If the transfer characteristic is to be identified from the output signal (pressure signal) obtained when the M-series signal or the sine sweep is applied to the input signal (torque), which is a general method for identifying the transfer characteristic, the mechanical load comes into contact with and is separated away from the pressurized target 7. Therefore, the transfer characteristic cannot be precisely obtained. On the other hand, with the method according to the second embodiment, the transfer characteristic can be precisely obtained. Thus, the parameter of the pressure control section 12 can be appropriately adjusted based on the transfer characteristic.

The stability of the pressure control in terms of control is determined depending not only on the parameter of the pressure control section 12 but also on the gain parameter of the position control which is the minor loop and the gain parameters of the speed control which is the minor loop of the position control. According to the present invention, the configuration of the control of the minor loop is reflected in C(s) which is the transfer characteristic from the pressure command signal to the motor torque so that the parameter of the pressure control section 12 is set based on the configuration and the parameters of the control section which is the minor loop. Therefore, the appropriate parameter of the pressure control section 12 can be calculated.

Third Embodiment

The case where the speed control is provided as the minor loop of the pressure control has been described in the first embodiment, and the case where the position control is provided as the minor loop of the pressure control has been described in the second embodiment. However, even with a configuration in which the output of the pressure control section 12 directly becomes the torque of the motor without providing the minor loop, the control can be performed in the same manner as in the first and second embodiments. In the third embodiment, the above-mentioned configuration without the minor loop is described.

Figure 15:
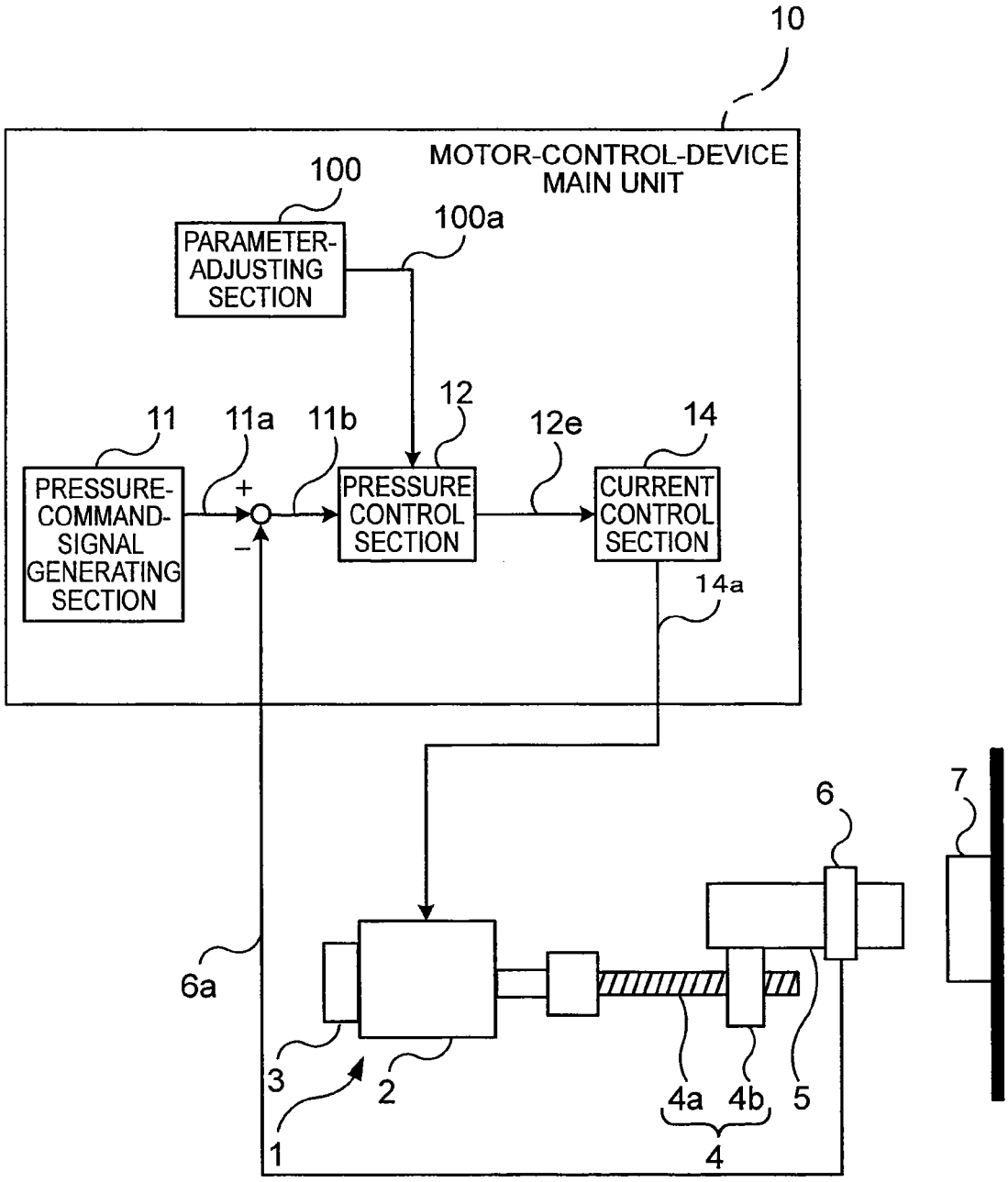
FIG. 15 A block diagram illustrating a motor control device according to a third embodiment of the present invention.

FIG. 15 is a block diagram illustrating a motor control device according to the third embodiment of the present invention. In FIG. 15, a configuration of a motor-control-device main unit 10 of the third embodiment is the same as the configuration of the motor-control-device main unit 10 of the first embodiment except that the speed control section 13 is omitted. Here, differences from the first embodiment are mainly described.

A pressure control section 12 of the third embodiment performs a pressure control computation based on a signal of a deviation (difference) between the value of the pressure command signal 11*a* and the value of the pressure detection signal 6*a* so that the value of the pressure detection signal 6*a* becomes equal to the value of the pressure command signal 11*a*, thereby calculating a torque command value so as to generate a torque command signal 13*e* which is a signal thereof. A parameter-adjusting section 100 of the third embodiment adjusts the parameter of the pressure control section 12 based on the elastic constant of the pressurized target 7, the information regarding the reaction force, and the transfer characteristic from the motor torque 20*c* to the motor speed.

Figure 16:
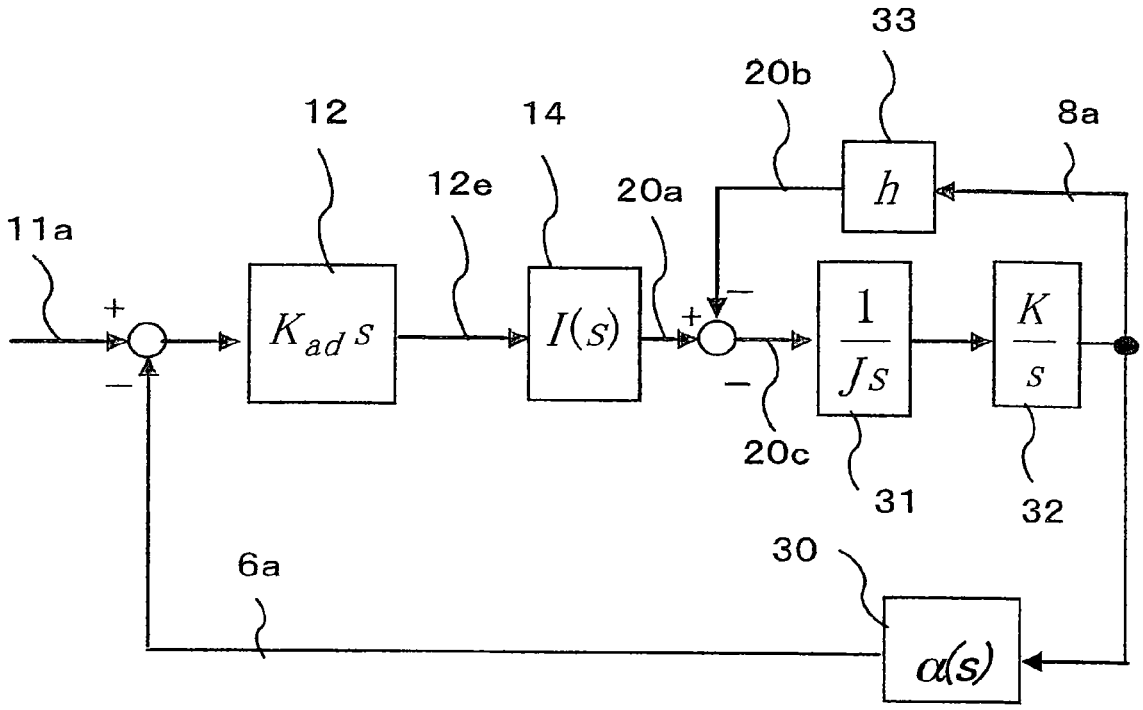
FIG. 16 A block diagram illustrating a transfer characteristic of a signal illustrated in FIG. 15.

FIG. 16 is a block diagram illustrating transfer characteristics of the signals illustrated in FIG. 15. FIG. 16 illustrates the transfer characteristics of the respective functional blocks illustrated in FIG. 15 other than the pressure-command-signal generating section 11, the parameter-adjusting section 100, and the parameter information 100*a*. In FIG. 16, the blocks and signals denoted by the same reference symbols as those illustrated in FIGS. 2 and 15 have the same meanings as those in FIGS. 2 and 15. FIG. 16 illustrates the case where the differential control (a transfer characteristic of the pressure control section 12 is Kad·s. Kad is a parameter) is used as the pressure control computation of the pressure control section 12.

Figure 17:
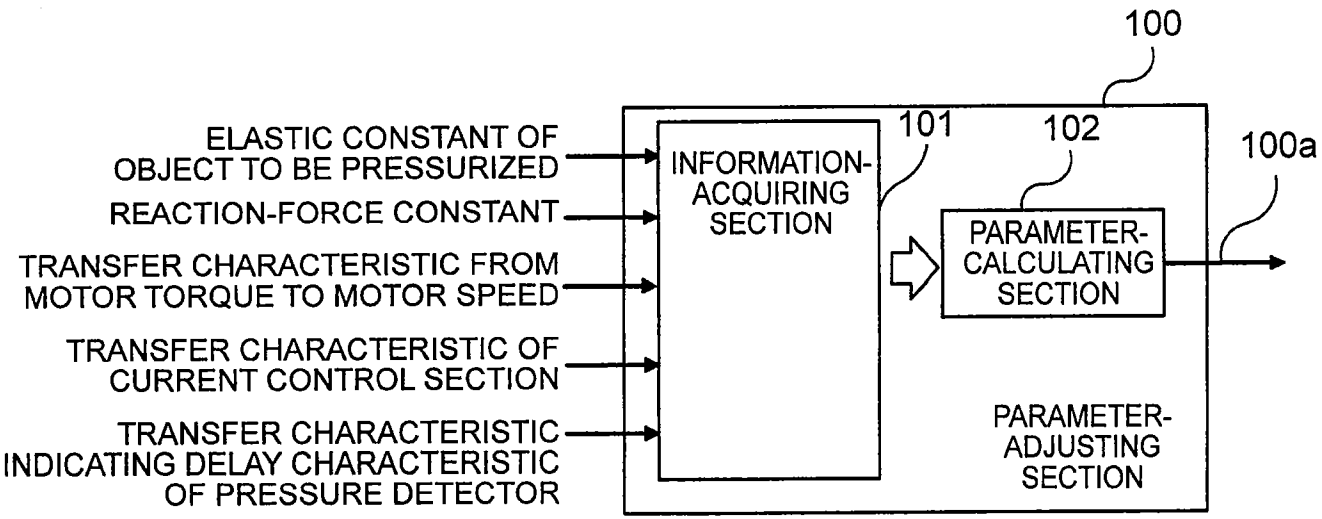
FIG. 17 A block diagram more specifically illustrating a parameter-adjusting section illustrated in FIG. 15.

FIG. 17 is a block diagram more specifically illustrating the parameter-adjusting section 100 illustrated in FIG. 15. An information-acquiring section 101 of the third embodiment acquires, from the exterior, each of the pieces of information including the elastic constant K of the pressurized target 7, the reaction-force constant h indicating the information of the reaction force, the transfer characteristic from the motor torque 20*c* to the motor speed, as is represented by Expressions (1) and (2) described above, the transfer characteristic I(s) of the current control section 14, and the transfer characteristic $\alpha(s)$ indicating the delay of the pressure detector 6. Note that, when each piece of the information of the transfer characteristic I(s) of the current control section 14 and the transfer characteristic $\alpha(s)$ indicating the delay of the pressure detector 6 is negligibly small, that is, can be both regarded as 1, the acquisition of the information thereof may be omitted. A parameter-calculating section 102 calculates the parameter (Kad in FIG. 16) of the pressure control section 12 based on the above-mentioned information.

Figure 18:
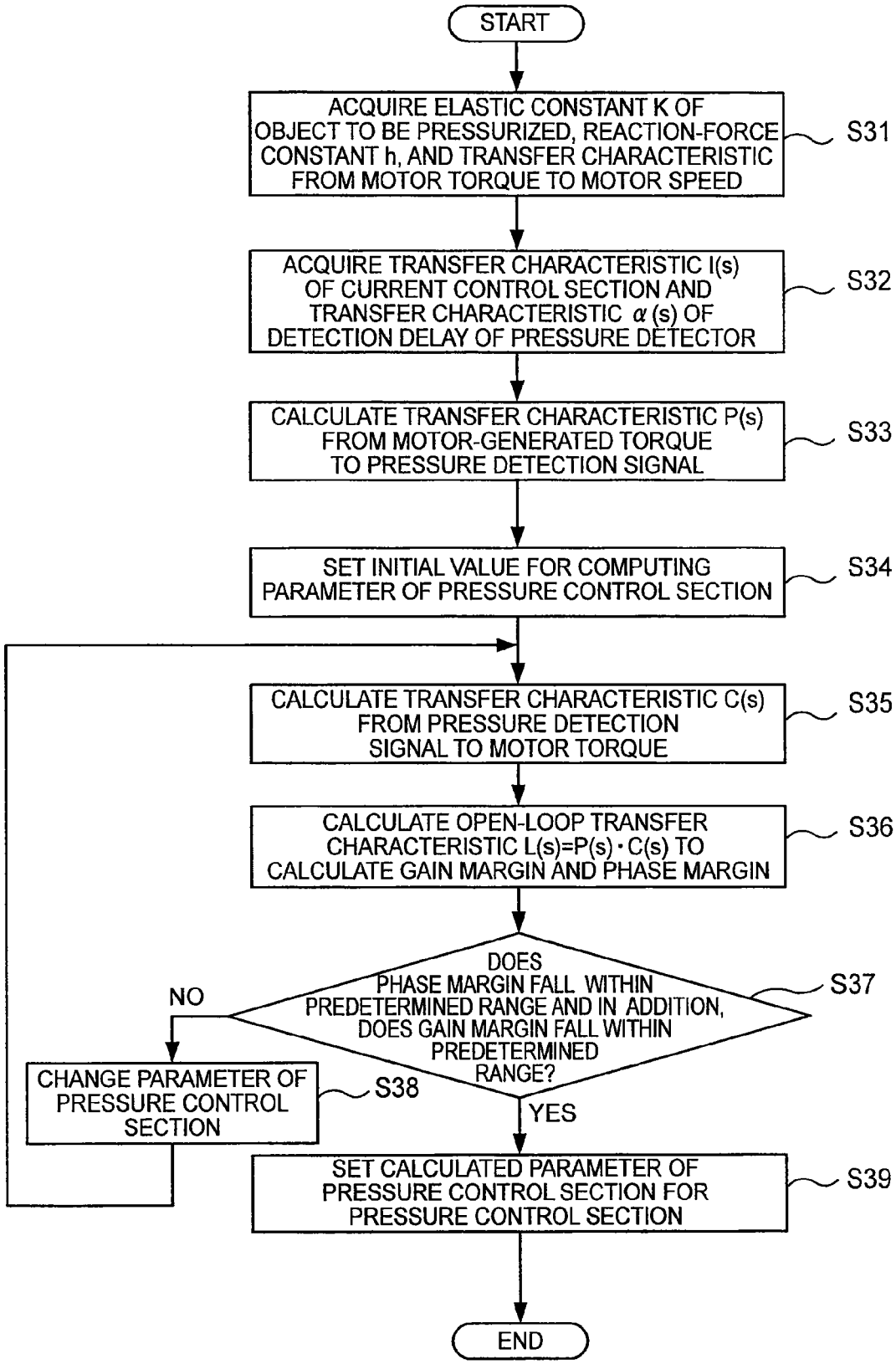
FIG. 18 A flowchart illustrating an operation of the parameter-adjusting section illustrated in FIG. 15.

Next, an operation performed when the parameter-adjusting section 100 illustrated in FIG. 15 adjusts the parameter Kad of the pressure control section 12 is described. FIG. 18 is a flowchart illustrating an operation of the parameter-adjusting section 100 illustrated in FIG. 15. First, in Step S31, the parameter-adjusting section 100 acquires the transfer characteristic from the motor torque 20*c* to the motor speed, the elastic constant K of the pressurized target 7, and the reaction-force constant h. Next, in Step S32, the parameter-adjusting section 100 acquires the transfer characteristic I(s) of the current control section 14 and the transfer characteristic $\alpha(s)$ indicating the delay in detection of the pressure detector 6. Note that, when the delay characteristics of both the transfer characteristics are small, Step S32 may be omitted so that the processing proceeds to Step S33.

In Step S33, the parameter-adjusting section 100 calculates the transfer characteristic P(s) from the motor-generated torque 20*a* to the pressure detection signal 6*a*. Then, in Step S34, the parameter-adjusting section 100 sets an initial value for computing the parameter Kad of the pressure control section 12. The processing performed in Steps S32 to S34 is almost the same as that performed in Steps S2 to S4 illustrated in FIG. 5.

In Step S35, the parameter-adjusting section 100 calculates the transfer characteristic C(s) from the pressure detection signal 6*a* to the motor-generated torque 20*a*. When the pressure control section 12 performs the differential control, C(s)=Kai·s is obtained.

Next, in Step S36, the parameter-adjusting section 100 calculates the open-loop transfer characteristic L(s)=P(s)·C(s) based on Steps S31 to S35 and then calculates the gain margin and the phase margin of the open-loop transfer characteristic. Next, in Step S37, the parameter-adjusting section 100 verifies whether or not both the gain margin and the phase margin of the open-loop transfer characteristic fall within the predetermined ranges.

In Step S37, when at least any one of the gain margin and the phase margin does not fall within the corresponding predetermined range, the parameter-adjusting section 100 changes the parameter Kad of the pressure control section 12 in Step S38 to repeatedly execute the processing in Steps S35 to S37 again. As a way to change the parameter of the pressure control section 12, Kad is increased when at least any one of the gain margin and the phase margin is larger than the corresponding predetermined range, whereas Kad is reduced when at least any one of the gain margin and the phase margin is smaller than the corresponding predetermined range.

On the other hand, when both the gain margin and the phase margin fall within the predetermined ranges in Step S37, the processing of the parameter-adjusting section 100 proceeds to Step S39. In Step S39, the parameter of the pressure control section 12, which is obtained by the preceding processing, is set for the pressure control section 12. Then, the parameter-adjusting section 100 ends the operation series.

The computation method of the third embodiment uses the transfer characteristic from the motor-generated torque 20*a* to the pressure detection signal 6*a*, which includes the pressurized target 7. If the transfer characteristic is to be identified from an output signal (pressure signal) obtained when the M-series signal or the sine sweep is applied to the input signal (torque), which is a general method for identifying the transfer characteristic, the mechanical load comes into contact with and is separated away from the pressurized target 7. Therefore, the transfer characteristic cannot be precisely obtained. On the other hand, with the method according to the third embodiment, the transfer characteristic can be precisely obtained. Thus, the parameter of the pressure control section 12 can be appropriately adjusted based on the transfer characteristic.

Fourth Embodiment

In the first to third embodiments, the configuration, in which the parameter of the pressure control section 12 is calculated by mainly using the elastic constant of the pressurized target 7, the transfer characteristic from the motor torque 20*c* to the motor speed, and the information regarding the reaction force, has been described. On the other hand, in the fourth embodiment, a configuration for calculating the parameter of the pressure control section 12 by additionally using information of a friction characteristic, as in the case where a friction characteristic of the electric mechanism 4 illustrated in FIG. 1 is non-negligibly large, is described. In the fourth embodiment, a configuration in which the speed control is provided as the minor loop of the pressure control, as in the case of FIG. 1, is described as an example.

Figure 19:
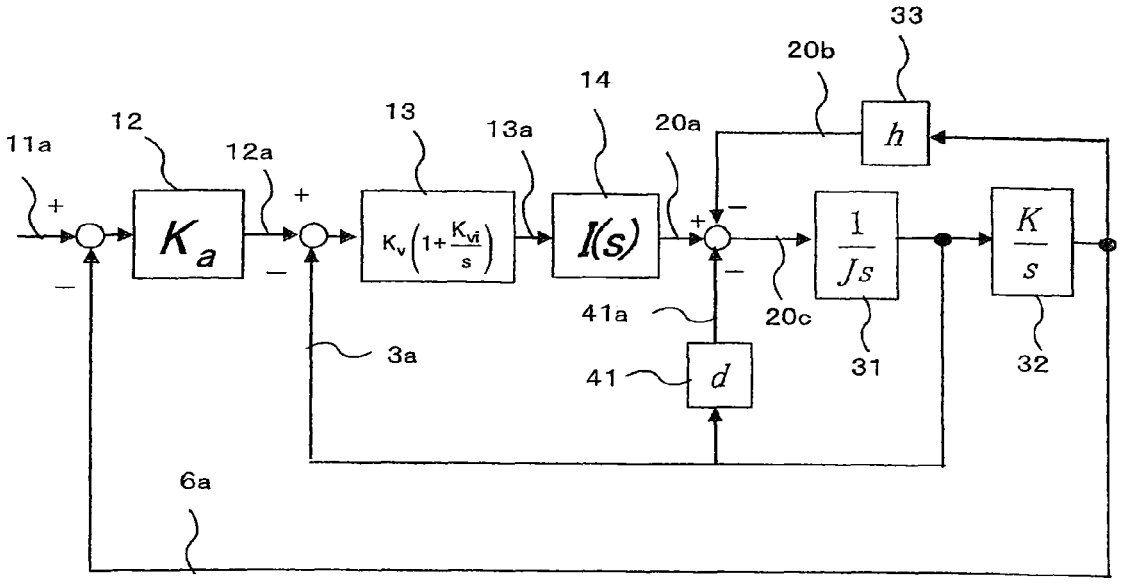
FIG. 19 A block diagram illustrating a transfer characteristic of a signal of a motor control device according to a fourth embodiment of the present invention.

FIG. 19 is a block diagram illustrating transfer characteristics of the signals of the motor control device according to the fourth embodiment of the present invention. FIG. 19 is obtained by re-depicting the block diagram of FIG. 1 in terms of the transfer characteristics between the signals in consideration of the case where the friction characteristic is large. In FIG. 19, blocks and signals denoted by the same reference symbols have the same meanings as those in the block diagram of FIG. 2 and therefore, the description thereof is omitted. The reference symbol 41 in FIG. 19 denotes a block indicating a viscous friction characteristic in which a friction torque is generated in proportion to the motor speed. A sign d in the block 41 is a constant indicating the viscous friction coefficient. A friction functions so as to block the movement of the motor and therefore, the friction torque is applied to the motor-generated torque 20*a* in a negative direction.

Figure 20:
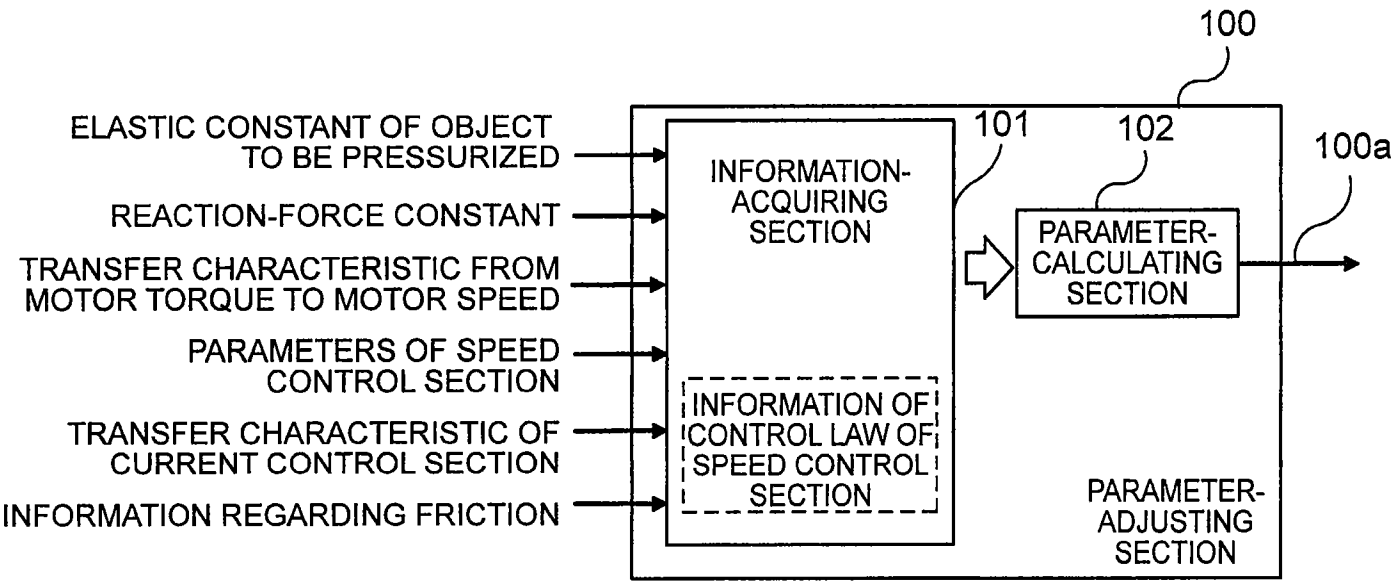
FIG. 20 A block diagram illustrating a parameter-adjusting section according to the fourth embodiment of the present invention.

FIG. 20 is a block diagram illustrating a parameter-adjusting section 100 according to the fourth embodiment of the present invention. In FIG. 20, as in the case of the first embodiment, an information-acquiring section 101 of the fourth embodiment acquires, from the exterior, each of the pieces of information including the elastic constant of the pressurized target 7, the information regarding the reaction force, the transfer characteristic from the motor torque 20*c* to the motor speed, the parameters of the speed control section 13, the transfer characteristic of the current control section 14, and the transfer characteristic indicating the delay in detection of the pressure detector 6.

Moreover, besides the above-mentioned information, the information-acquiring section 101 of the fourth embodiment acquires information regarding the friction from the exterior. As in the case of the first embodiment, when a delay is sufficiently small in each of the transfer characteristic of the current control section 14 and the transfer characteristic indicating the delay in detection of the pressure detector 6, the acquisition of the information thereof may be omitted. A parameter-calculating section 102 calculates the parameter of the pressure control section 12 based on the above-mentioned pieces of information.

Figure 21:
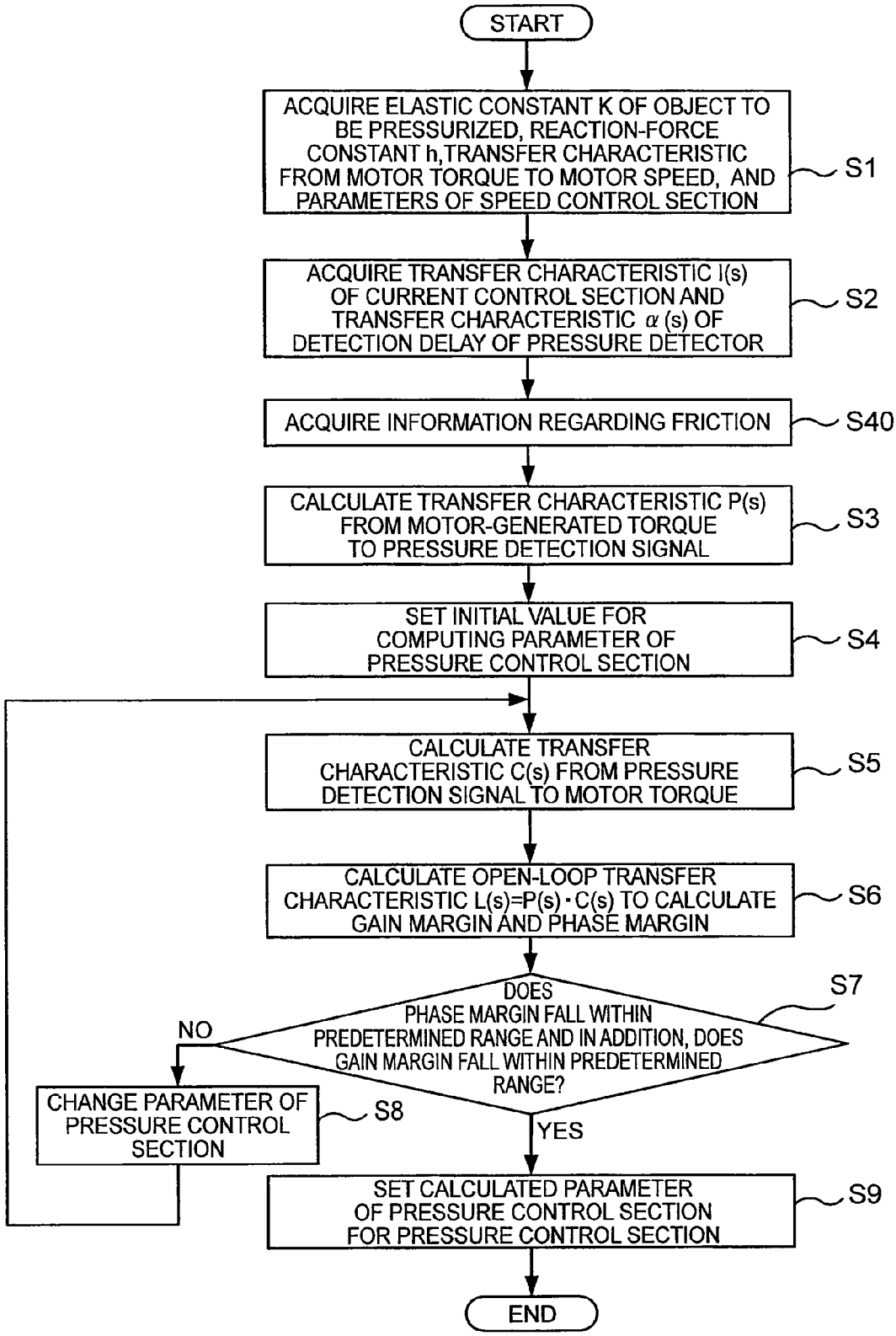
FIG. 21 A flowchart illustrating an operation of the parameter-adjusting section illustrated in FIG. 20.

Next, an operation performed when the parameter-adjusting section 100 illustrated in FIG. 20 adjusts the parameter Ka of the pressure control section 12 is described. FIG. 21 is a flowchart illustrating an operation of the parameter-adjusting section 100 illustrated in FIG. 20. A flow of processing illustrated in FIG. 21 is similar to the flow of processing of FIG. 5, which is described in the first embodiment. Therefore, the description of the same processing as that of the first embodiment is appropriately omitted in the following description.

In FIG. 21, the contents of processing in Steps S1 and S2 are the same as those of the first embodiment. In Step S40 where processing subsequent to Step S2 is performed, the parameter-adjusting section 100 acquires information regarding a viscous friction coefficient d of a viscous friction generated in proportional to the motor speed, which is information regarding the friction.

When the elastic constant of the pressurized target 7 is large (corresponding to the case where the pressurized target 7 is hard), the pressure and the motor position have a proportional relationship, and the elastic constant is large. Therefore, the pressurized target has a property that the pressure increases only by the movement of the motor 2 over a small distance. When the pressure control is executed on the pressurized target 7, the speed of the motor 2 becomes extremely small during the execution of the pressure control. Thus, the magnitude of the torque for the amount of viscous friction, which is generated in proportional to the magnitude of the speed, becomes almost negligible.

In this case, not the effects of the viscous friction but the effects of a non-linear friction characteristic such as a coulomb friction, which depends only on a direction of the motor speed to generate the friction torque having a constant value, on the pressure control become greater. The coulomb friction cannot be expressed as a linear transfer characteristic as in the case of the viscous friction. Therefore, when the non-linear friction characteristic such as the coulomb friction is dominant, the viscous friction coefficient d calculated by linear approximation is used.

Figure 22:
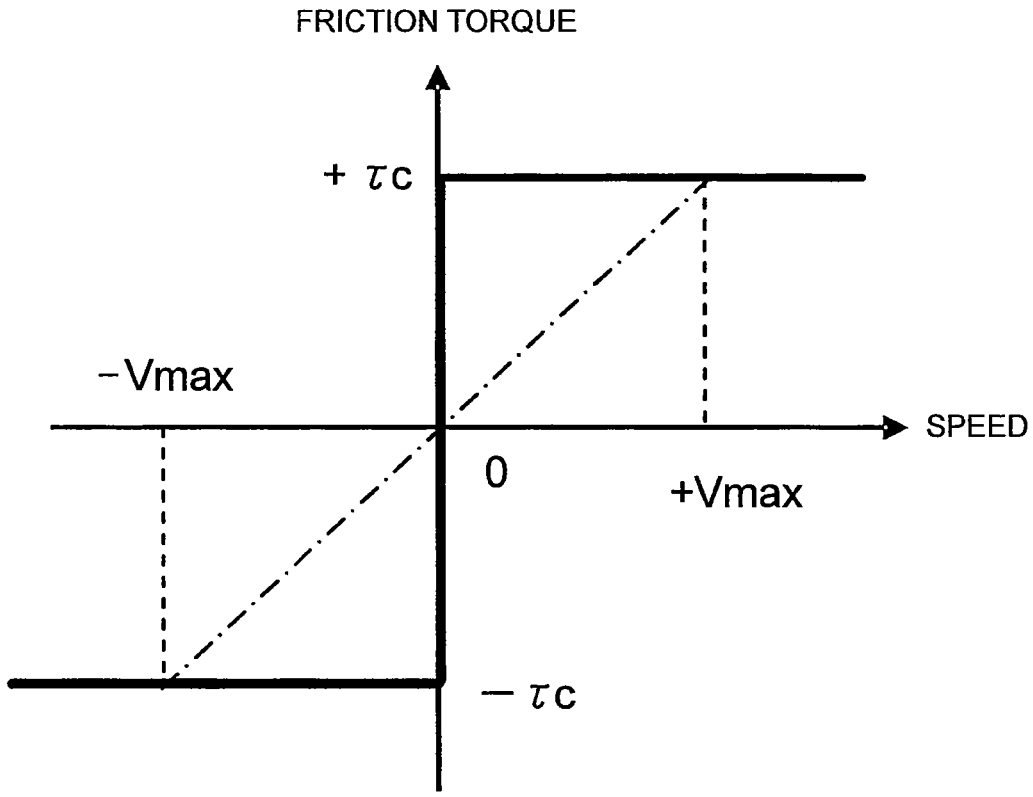
FIG. 22 A graph for showing an example of linear approximation of a viscous friction coefficient.

An example of the linear approximation is described referring to FIG. 22. In FIG. 22, the coulomb friction, which is an example of the non-linear friction, is indicated by a thick solid line. In the case of the coulomb friction, a positive friction torque $\tau c$ is generated regardless of the magnitude of the motor speed when the motor speed has a positive direction, whereas a negative friction torque $-\tau c$ is generated regardless of the magnitude of the motor speed when the motor speed has a negative direction. When a maximum value of the motor speed during the pressure control is Vmax, an approximation d of the viscous friction coefficient is approximated as $d=\tau c/Vmax$. The thus approximated viscous friction is indicated by an alternate long and short dash line in FIG. 22.

In FIG. 22, when the motor speed changes from −Vmax to +Vmax, the approximated viscous friction corresponds to the approximation with a friction smaller than the coulomb friction indicated by the thick line before the approximation. The friction functions in a direction in which the operation of the motor 2 is blocked. Therefore, when the friction becomes greater, the pressure control is more likely to be stable. The parameter of the pressure control is calculated based on the friction characteristic obtained by the approximation with the small friction. As a result, a conservative parameter of the pressure control is calculated. With the pressure control using the parameter of the pressure control, stable pressure control can be realized under the conditions in which a friction larger than the approximated friction characteristic is applied.

As an example of the calculation of Vmax, the use of the elastic constant and a gradient of a change in the pressure command value is given. When the pressure control is performed, the value of the pressure detection value follows the pressure command value. Therefore, the pressure command value and the pressure detection value are approximately equal to each other. Moreover, the pressure and the motor position have a proportional relationship. Therefore, the pressure command value and the motor position also have a proportional relationship. Further, values obtained by differentiating the pressure command value and the motor position, that is, a value obtained by differentiating the pressure command value and the motor speed obtained by differentiating the motor position also have a proportional relationship.

Figure 23:
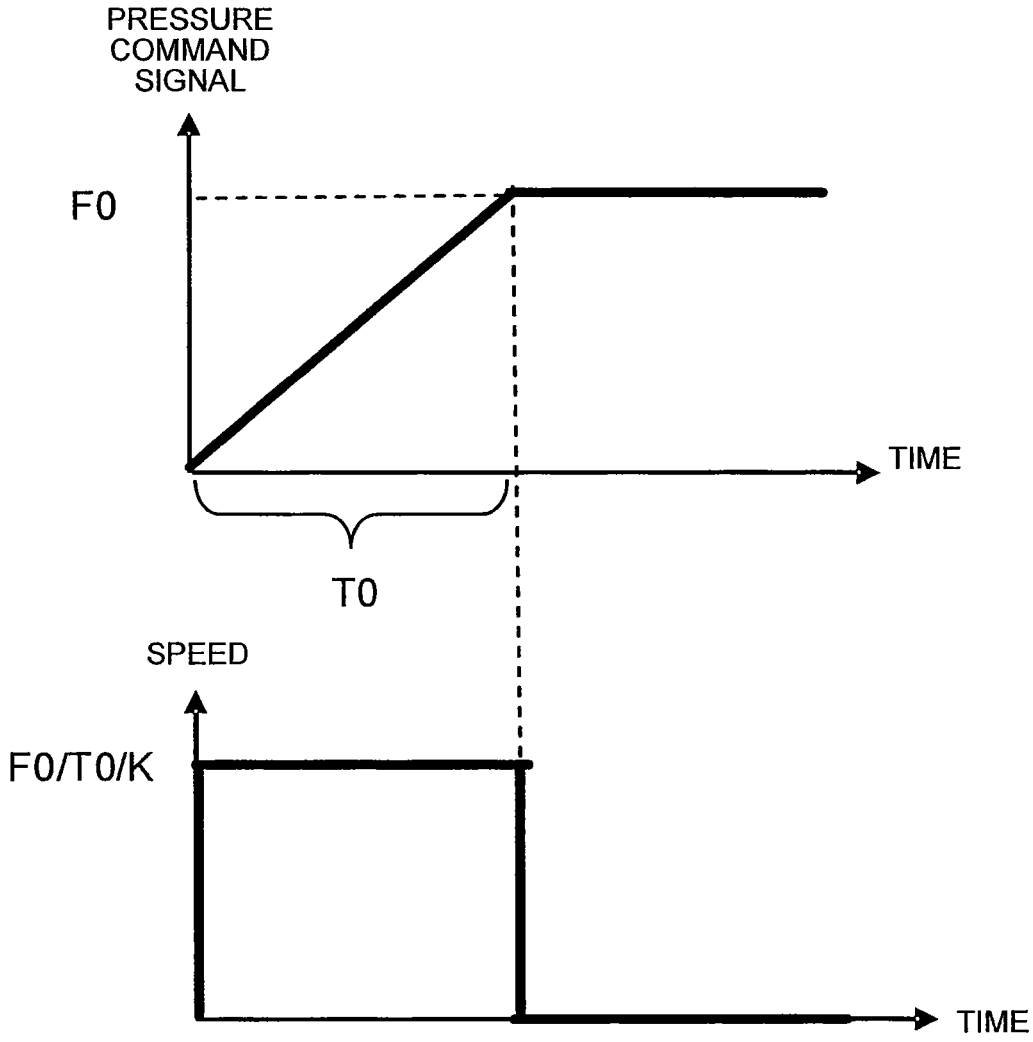
FIG. 23 A graph for showing the relationship between a motor speed and a pressure command value.

The proportionality constant is indicated by the elastic constant K. Therefore, the motor speed can be regarded as being equal to a value obtained by dividing the value obtained by differentiating the pressure command value by the elastic constant of the pressurized target 7. A maximum value of the motor speed is determined from the gradient of the change in the pressure command value. FIG. 23 is a graph for showing the relationship between the motor speed and the pressure command value (pressure command signal). In FIG. 23, when the pressure command value linearly increases from a pressure 0 to F0 over time T0, the motor speed has a value obtained by dividing a gradient F0/T0 of the change in the pressure command value by the elastic constant K of the pressurized target 7. Specifically, the viscous friction coefficient can be obtained from the value obtained by dividing the gradient F0/T0 of the change in the pressure command value by the elastic constant K of the pressurized target 7.

In FIG. 23, the example in which the pressure command value increases linearly is shown. When the pressure command value does not increase or decrease linearly, a maximum value of the gradient of the change in the pressure command value may be used. Moreover, the pressure command value is information previously given as specifications when the pressure control is performed. Therefore, by using the information, the maximum speed of the motor 2 during the pressure control can be obtained before the pressure control is actually performed. In the description given above, an example of the linear approximation is described. The linear approximation is not limited to the example, and a describing function method of approximating the non-linear transfer characteristic with a linear transfer characteristic may be used.

Next, in Step S3, the parameter-adjusting section 100 calculates the transfer characteristic from the motor-generated torque 20*a* to the pressure detection signal. In this case, when the viscous friction or the approximated viscous friction coefficient d is used, the following Expression (16) expressing the transfer characteristic from the motor-generated torque 20*a* to the pressure detection signal is calculated.

[Math. 16]

$$P(s) = \frac{K}{Js^2 + d \cdot s + h \cdot K}\alpha(s) \tag{16}$$

The transfer characteristic expressed by Expression (16) represents a transfer characteristic containing not only the information regarding the elastic constant of the pressurized target 7 and the reaction force but also the information regarding the friction of the viscous friction coefficient d. The processing in Steps S4 to S9 illustrated in FIG. 21 is the same as that of the first embodiment and therefore, the description thereof is omitted.

Next, the effectiveness of the fourth embodiment based on the result of a simulation is described. The simulation was performed under the same conditions as those of the simulation of the first embodiment, which is shown in FIG. 9, except for the information regarding the friction. Specifically, the conditions were the use of the transfer characteristic from the motor torque 20*c* to the motor speed expressed by Expression (1), J=1.0e-3 [kg·m$^2$], the reaction-force constant h=3.18e-3 [N·m/N], the elastic constant K=1.44e+4 [N/rad], the transfer characteristic of the current control section 14 I(s)=exp(−0.003 s), and a sufficiently small detection delay characteristic of the pressure detector 6, that is, α(s)=1.

The configuration of the pressure control was a configuration in which the speed control was provided as a minor loop of the pressure control as in the case illustrated FIG. 19. The pressure control section 12 performed the proportional control (the parameter of the pressure control section 12 is Ka which is the proportional gain), whereas the speed control section 13 performed the proportional and integral control (the parameters of the speed control section 13 are the proportional gain Kv and the integral gain Kvi). The parameters were set as Kv=0.15 [(N·m)/(rad/s)] and Kvi=50 [rad/s].

Besides the conditions described above, the viscous friction coefficient d=0.05 [(N·m)/(rad/s)] was set as a condition because of a large friction of the machine. Based on the above-mentioned information, the parameter of the pressure control section 12 was calculated by the parameter-adjusting section 100. Then, as in the case of the simulation shown in FIG. 9, the adjustment was performed so that the gain margin of the open-loop transfer characteristic in Step S7 of FIG. 21 became equal to or larger than 5 dB and smaller than 5.5 dB and the phase margin became equal to or larger than 5 degrees. Then, the parameter of the pressure control section 12 was calculated as Ka=0.0181 [(rad/s)/N].

Therefore, according to the result of the simulation, it is understood that, as compared with the parameter of the pressure control section 12, Ka=0.0069 [(rad/s)/N], which was calculated when the simulation shown in FIG. 9 was performed under the same conditions as those of this simulation except for the friction characteristic, a large value is calculated as the parameter Ka of the pressure control section 12.

Figure 24:
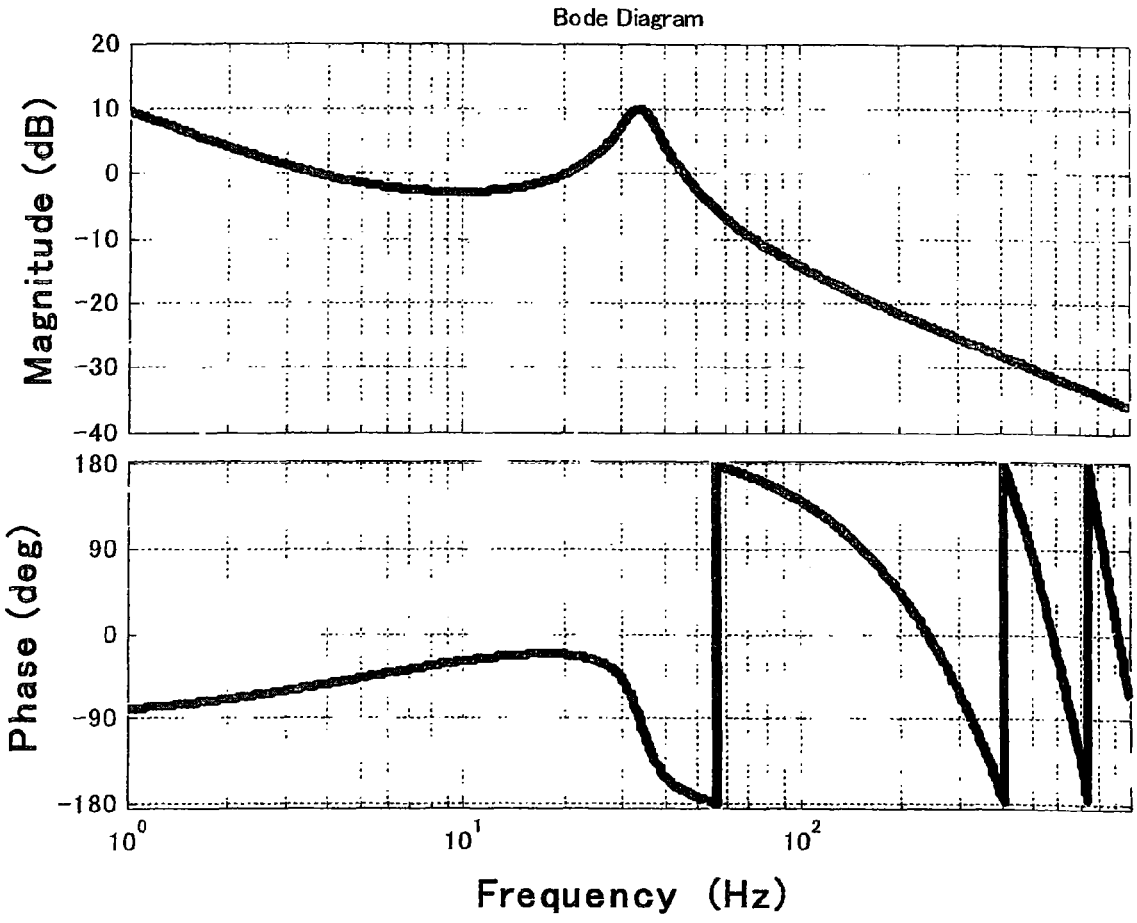
FIG. 24 A Bode diagram showing an open-loop transfer characteristic when a parameter of a pressure control section, which is calculated in accordance with the flowchart of FIG. 21, is adopted.

Next, a Bode diagram of the open-loop transfer characteristic L(s)=P(s)·C(s) when the proportional gain of the pressure control section 12, Ka=0.0181 [(rad/s)/N], which is calculated in accordance with the flowchart of FIG. 21, is adopted, is shown in FIG. 24. According to FIG. 24, it is understood that a peak characteristic at about 34 Hz becomes small as compared with FIG. 6 under the conditions without the friction. This is because the information indicating the action of the large viscous friction is reflected in P(s) which is the transfer characteristic from the motor-generated torque 20*a* to the pressure detection signal. By the reduction of the peak characteristic as described above, the predetermined gain margin and phase margin are achieved even when the parameter Ka of the pressure control section 12 is made larger than that under the conditions for FIG. 9.

Figure 25:
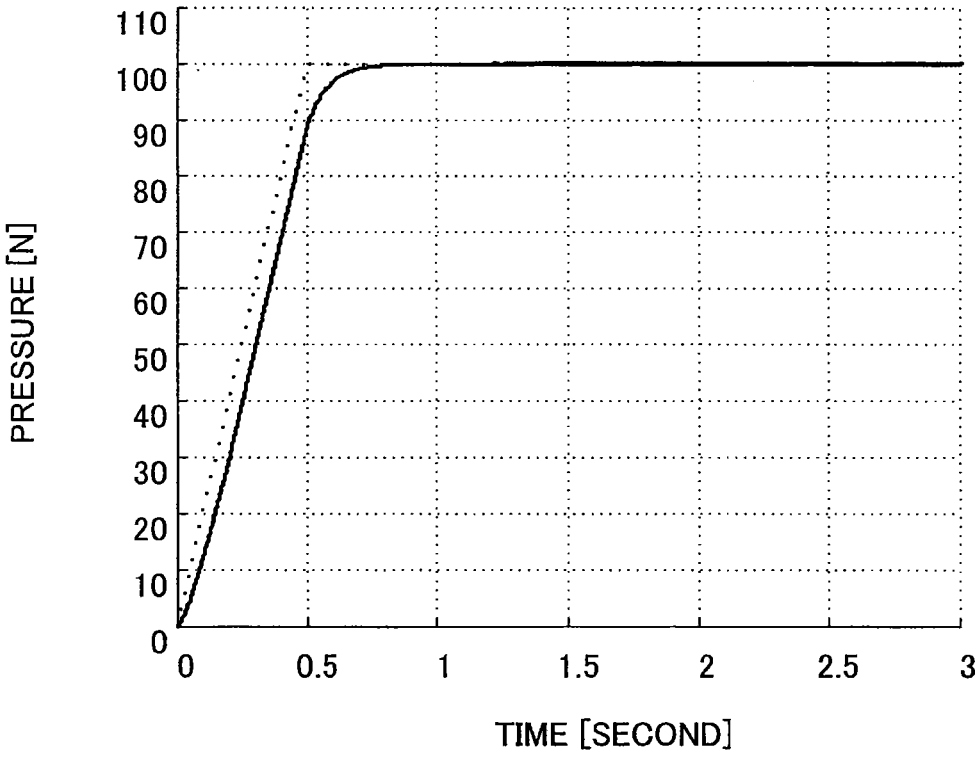
FIG. 25 A graph showing a time response of a pressure detection signal when the parameter of the pressure control section, which is calculated in accordance with the flowchart of FIG. 21, is adopted.

FIG. 25 is a graph showing a time response of the pressure detection signal when the parameter of the pressure control section 12, which is calculated in accordance with the flowchart of FIG. 21, is adopted. FIG. 25 shows a simulation waveform of the time response of the pressure detection signal when the proportional gain of the pressure control section 12 was set as Ka=0.0181 [(rad/s)/N]. As the pressure command signal, the same signal as that of the case shown in FIGS. 7 to 9 is used. In FIG. 25, the pressure command signal 11*a* is indicated by a dotted line, whereas the pressure detection signal 6*a* is indicated by a solid line.

According to FIG. 25, overshoot, in which the pressure detection signal becomes larger than the pressure command signal, and vibrations in the pressure detection signal itself do not occur. Therefore, good pressure control is realized. Further, it is understood that a following characteristic of the pressure detection signal to the pressure command signal is slightly improved from the following characteristic shown in FIG. 9, Specifically, it is verified that the pressure is 90 [N] at time 0.5 [seconds] in FIG. 25, whereas the pressure is 85 [N] at time 0.5 [seconds] in FIG. 9.

This is because the parameter of the pressure control section 12 is calculated to be larger than that of the pressure control section 12, which was set by the simulation shown in FIG. 9. For the calculation of the parameter of the pressure control, when the friction characteristic is taken into consideration, the parameter of the pressure control, which provides the same degree of stability and higher followability of the pressure control, can be calculated.

In the fourth embodiment, the case where the minor loop of the pressure control is the speed control has been described. However, as in the case of the second and third embodiments, the fourth embodiment can be carried out in the same manner even in the case where the minor loop of the pressure control is the position control or the torque control. Further, even when the rotary motor or the linear motor is used as the motor, the fourth embodiment can be carried out in the same manner.

Fifth Embodiment

The parameter-adjusting section 100 of the first embodiment adjusts the parameter of the pressure control section 12 by taking advantage of the fact that the transfer characteristic from the pressure detection signal 6*a* to the motor speed is the transfer characteristic containing the differential characteristic having the reciprocal of the elastic constant of the pressurized target 7 as the proportionality constant. On the other hand, when the minor loop of the pressure control is the speed control, a parameter-adjusting section 100 of a fifth embodiment calculates the transfer characteristic from the speed command to the pressure detection signal 6*a* in a state in which the speed control loop, which is the minor loop, is closed, so as to adjust the parameter of the pressure control section 12 by taking advantage of the transfer characteristic from the speed command to the pressure detection signal 6*a*.

The schema of a configuration of a motor-control-device main unit 10 of the fifth embodiment is the same as that of the motor-control-device main unit 10 of the first embodiment. In the fifth embodiment, a part of contents of processing by a parameter-calculating section 102 differs from that of the first embodiment. Moreover, a flow of the information of the parameter-adjusting section 100 of the fifth embodiment is the same as that of the information of the first embodiment, which is illustrated in FIGS. 3 and 4.

Figure 26:
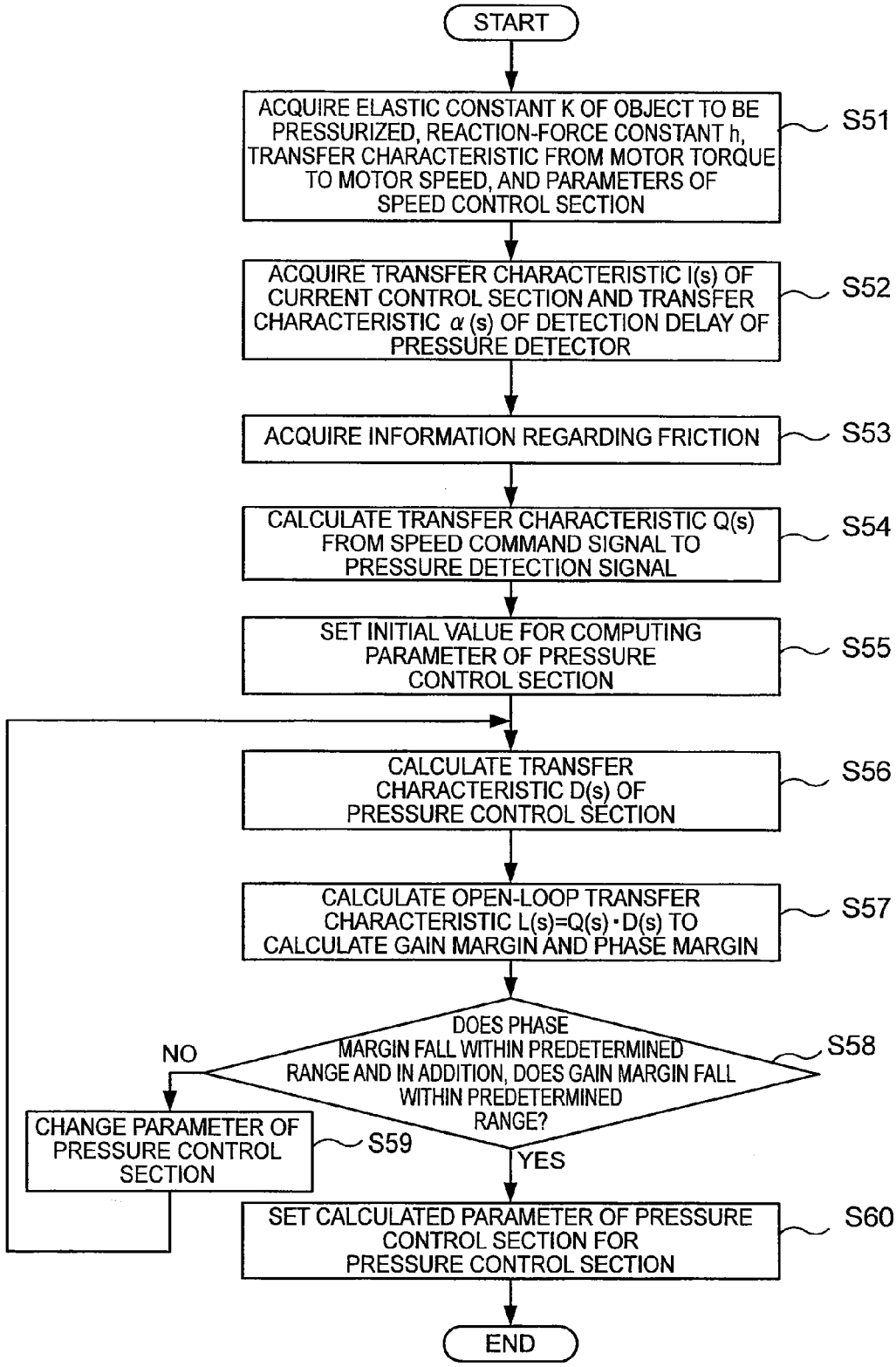
FIG. 26 A flowchart illustrating an operation of a parameter-adjusting section according to a fifth embodiment of the present invention.

Next, an operation performed when the parameter-adjusting section 100 of the fifth embodiment adjusts the parameter Ka of the pressure control section 12 is described. FIG. 26 is a flowchart illustrating the operation of the parameter-adjusting section 100 of the fifth embodiment. In the following, description is given of an example of the contents of processing in the case where the pressure control section 12 performs the proportional control and the speed control section 13, which is the minor loop of the pressure control, performs the proportional and integral control. The flowchart of FIG. 26 includes steps, in which processing similar to that of the flowchart illustrated in FIG. 5 is performed. Only the outline is described for the similar portions described above, and different portions are described in detail.

In FIG. 26, first, in Step S51, the parameter-adjusting section 100 acquires the transfer characteristic from the motor torque 20*c* to the motor speed, the elastic constant K of the pressurized target 7, the reaction-force constant h, and the parameters Kv and Kvi of the speed control section 13. The information of the control law of the speed control section 13 is stored previously in the parameter-adjusting section 100 (information-acquiring section 101).

Next, in Step S52, the parameter-adjusting section 100 acquires the transfer characteristic I(s) of the current control section 14 and the transfer characteristic α(s) indicating the delay in detection of the pressure detector 6. When the delay characteristics of both of the transfer characteristics are small, Step S52 may be omitted so that the processing proceeds to Step S53.

In Step S53, the parameter-adjusting section 100 acquires the information regarding the friction. The information regarding the friction as used herein is information regarding the viscous friction coefficient d of the machine or the friction coefficient d obtained by linearizing the non-linear friction characteristic such as the coulomb friction or the like, as in the case of the fourth embodiment. When the friction characteristic is negligibly small, Step S53 may be omitted so that the processing proceeds to next Step S54.

In Step S54, the parameter-adjusting section 100 calculates the transfer characteristic Q(s) from the speed command signal 12*a* to the pressure detection signal 6*a* based on the information acquired in Steps S51 to S53. When the transfer characteristic from the motor-generated torque 20*a* to the motor speed can be expressed by Expression (1) described above and the control law of the speed control section 13 is the proportional and integral control (block 13 illustrated in FIGS. 2 and 19), the transfer characteristic is calculated as expressed by the following Expression (17), specifically.

[Math. 17]

$$Q(s) = \frac{K \cdot \frac{1}{Js} \cdot K_v\left(1 + \frac{K_{vi}}{s}\right) \cdot I(s)}{\left\{s \cdot \left(1 + K_v\left(1 + \frac{K_{vi}}{s}\right) \cdot I(s) + d\right) + h \cdot K\right\} \cdot \frac{1}{Js}} \alpha(s) = \frac{K \cdot K_v(s + K_{vi}) \cdot I(s)}{Js^3 + ds^2 + hKs + sK_v(s + K_{vi})I(s)} \alpha(s) \quad (17)$$

The above-mentioned relationship is obtained by calculating the transfer characteristic from the speed command signal 12*a* to the pressure detection signal 6*a* based on the relationship between the blocks illustrated in FIGS. 2 and 19. When the machine has a resonant characteristic, by substituting Expression (2) into 1/(Js) of the first expression in Expression (17), the transfer characteristic can be similarly calculated. When the transfer characteristic of the current control section 14 and the delay characteristic of the pressure detector 6 are negligibly small and therefore, the acquisition of the information of the transfer characteristic of the current control section 14 or the delay characteristic of the pressure detector 6 is omitted in Step S52, the transfer characteristic and the delay characteristic may be respectively set as I(s)=1 and α(s)=1. Moreover, when the friction characteristic is negligibly small and the acquisition of the information thereof is omitted in Step S53, the processing may be performed with d=0.

Next, in Step S55, the parameter-adjusting section 100 sets an initial value for computing the parameter Ka of the pressure control section 12. In Step S56, the parameter-adjusting section 100 acquires the transfer characteristic D(s) of the pressure control section 12. In the example of the fifth embodiment, the pressure control section 12 has the configuration in which the proportional control is performed. Therefore, by using the parameter Ka of the pressure control section 12, D(s)=Ka is obtained.

In Step S57, the parameter-adjusting section 100 calculates the open-loop transfer characteristic L(s)=Q(s)·D(s) from Q(s) and D(s) respectively obtained in Steps S54 and 56 and then calculates the gain margin and the phase margin of the open-loop transfer characteristic. In Step S58, the parameter-adjusting section 100 verifies whether or not the gain margin and the phase margin of the open-loop transfer characteristic both fall within the predetermined ranges.

When at least any one of the gain margin and the phase margin does not fall within the corresponding predetermined range in Step S58, the parameter-adjusting section 100 changes the parameter Ka of the pressure control section 12 in Step S59. On the other hand, when the gain margin and the phase margin both fall within the predetermined ranges in Step S58, the processing of the parameter-adjusting section 100 proceeds to Step S60. In Step S60, the parameter of the pressure control section 12, which is obtained by the preceding processing, is set for the pressure control section 12. Then, the parameter-adjusting section 100 ends the operation series.

Next, the effects of the fifth embodiment are described. The stability of the pressure control is determined depending not only on the parameter of the pressure control section 12 but also on the gain parameters of the pressure control section 13 which is the minor loop of the pressure control. In the fifth embodiment, the configuration and the parameter of the speed control section 13, which is the minor loop of the pressure control, are reflected in Q(s) which is the transfer characteristic from the speed command signal 12*a* to the pressure detection signal 6*a*. Based on the transfer characteristic, the parameter of the pressure control section 12 is adjusted. With the configuration described above, a further appropriate parameter of the pressure control section 12 can be calculated in consideration of the control law and the parameters of the speed control section 13 which is the minor loop of the pressure control. As a result, the control performance such as the followability to the pressure command value can be improved while the stability of the control system is ensured.

Sixth Embodiment

In the fifth embodiment, the configuration using the speed control as the minor loop of the pressure control has been described. On the other hand, in a sixth embodiment, a configuration using both the speed control and the position control as the minor loop of the pressure control is described.

The schema of a configuration of a motor-control-device main unit 10 of the sixth embodiment is the same as that of the motor-control-device main unit 10 of the second embodiment. In the sixth embodiment, a part of contents of processing by a parameter-calculating section 102 differs from that of the second embodiment. Moreover, a flow of information of a parameter-adjusting section 100 of the sixth embodiment is the same as that of the information of the second embodiment, which is illustrated in FIG. 13.

Figure 27:
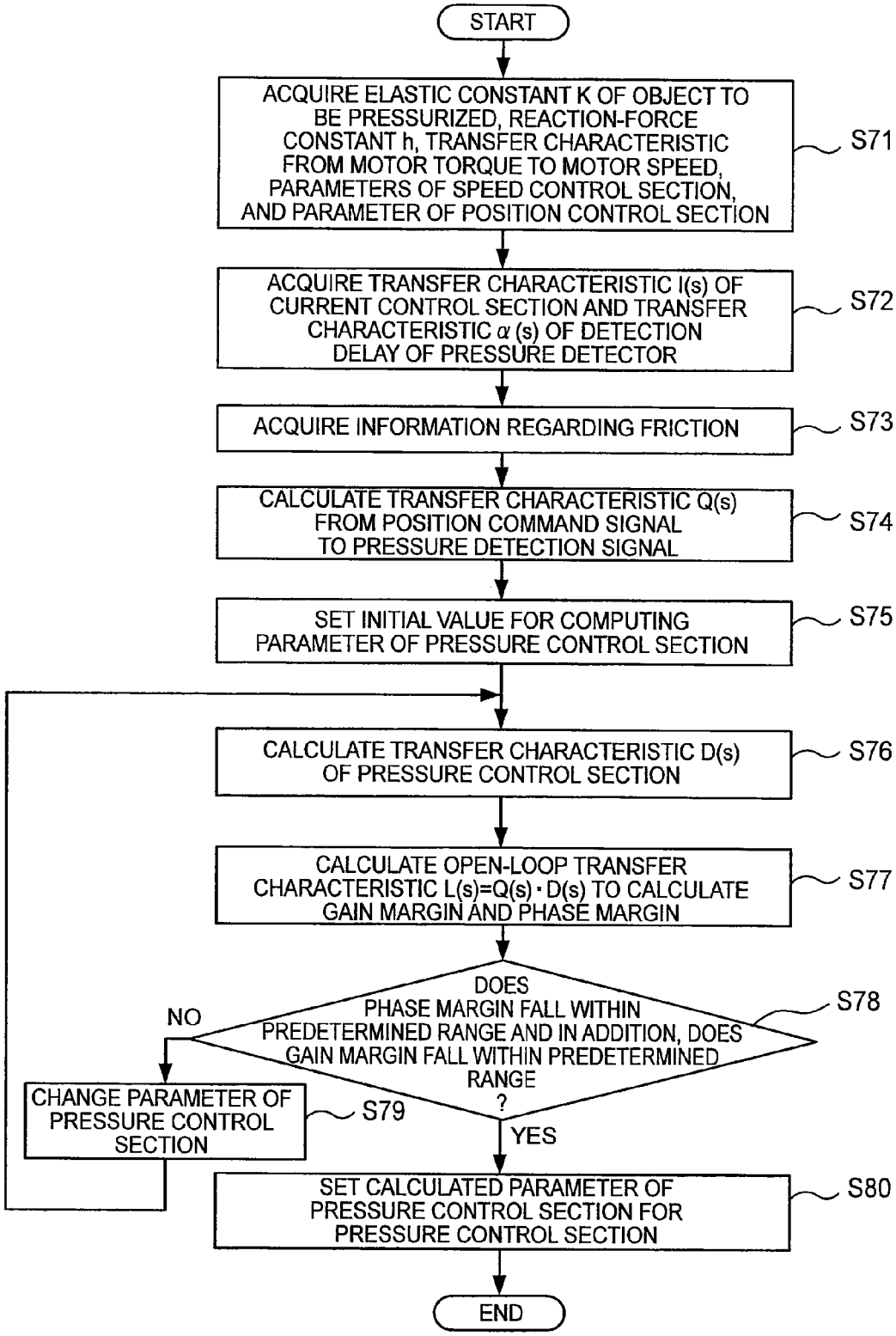
FIG. 27 A flowchart illustrating an operation of a parameter-adjusting section according to a sixth embodiment of the present invention.

Next, an operation performed when the parameter-adjusting section 100 of the sixth embodiment adjusts the parameter Kai of the pressure control section 12 is described. FIG. 27 is a flowchart illustrating the operation of the parameter-adjusting section 100 of the sixth embodiment. In the following, description is given of an example of the contents of processing in the case where the pressure control section 12 performs the integral control, the position control section 15 performs the proportional control, and the speed control section 13 performs the proportional and integral control as illustrated in FIG. 12. The flowchart of FIG. 27 includes steps, in which processing similar to that of the flowchart illustrated in FIG. 14 is performed. Only the outline is described for the similar portions described above, and different portions are described in detail.

In FIG. 27, first, in Step S71, the parameter-adjusting section 100 acquires the transfer characteristic from the motor torque 20*c* to the motor speed, the elastic constant K of the pressurized target 7, the reaction-force constant h, the parameters Kv and Kvi of the speed control section 13, and the parameter Kp of the position control section 15. The information of the control law of each of the speed control section 13 and the position control section 15 is stored previously in the parameter-adjusting section 100 (information-acquiring section 101).

Next, in Step S72, the parameter-adjusting section 100 acquires the transfer characteristic I(s) of the current control section 14 and the transfer characteristic α(s) indicating the delay in detection of the pressure detector 6. When the delay characteristics of both of the transfer characteristics are small, Step S72 may be omitted so that the processing proceeds to Step S73.

In Step S73, the parameter-adjusting section 100 acquires the information regarding the friction. The information regarding the friction as used herein is information regarding the viscous friction coefficient d of the machine or the friction coefficient d obtained by linearizing the non-linear friction characteristic such as the coulomb friction or the like, as in the case of the fourth embodiment. When the friction characteristic is negligibly small, Step S73 may be omitted so that the processing proceeds to next Step S74.

In Step S74, the parameter-adjusting section 100 calculates the transfer characteristic Q(s) from the position command signal 12*c* to the pressure detection signal 6*a* based on the information acquired in Steps S71 to S73. When the transfer characteristic from the motor-generated torque to the motor speed can be expressed by Expression (1) described above and the control law of the speed control section 13 is the PI control (block 13 illustrated in FIG. 2), the transfer characteristic is calculated as expressed by the following Expression (18), specifically. The above-mentioned relationship is obtained by calculating the transfer characteristic from the position command signal 12*a* to the pressure detection signal 6*a* based on the relationship between the blocks illustrated in FIG. 12.

[Math. 18]

$$Q(s) = \frac{K \cdot K_p K_v (s + K_{vi}) \cdot I(s)}{Js^3 + ds^2 + h \cdot Ks + K_v (s + K_p)(s + K_{vi}) I(s)} \alpha(s) \tag{18}$$

Next, in Step S75, the parameter-adjusting section 100 sets an initial value for the parameter Kai of the pressure control section 12. In Step S76, the parameter-adjusting section 100 acquires the transfer characteristic D(s) of the pressure control section 13. In the example of the sixth embodiment, the pressure control section 13 has the configuration in which the integral control is performed. Therefore, D(s)=Kai/s is obtained.

In Step S77, the parameter-adjusting section 100 calculates the open-loop transfer characteristic L(s)=Q(s)·D(s) from Q(s) and D(s) respectively obtained in Steps S74 and 76 and then calculates the gain margin and the phase margin of the open-loop transfer characteristic. In Step S78, the parameter-adjusting section 100 verifies whether or not the gain margin and the phase margin of the open-loop transfer characteristic both fall within the predetermined ranges.

When at least any one of the gain margin and the phase margin does not fall within the corresponding predetermined range in Step S78, the parameter-adjusting section 100 changes the parameter Kai of the pressure control section 12 in Step S79. On the other hand, when the gain margin and the phase margin both fall within the predetermined ranges in Step S78, the processing of the parameter-adjusting section 100 proceeds to Step S80. In Step S80, the parameter of the pressure control section 12, which is obtained by the preceding processing, is set for the pressure control section 12. Then, the parameter-adjusting section 100 ends the operation series.

Next, the effects of the sixth embodiment are described. The stability of the pressure control is determined depending not only on the parameter of the pressure control section 12 but also on the gain parameters of the position control section 15 and the pressure control section 13 which are the minor loops of the pressure control. In the sixth embodiment, the configurations and the parameters of the position control section 15 and the speed control section 13, which are the minor loops of the pressure control, are reflected in Q(s) which is the transfer characteristic from the position command signal 12*c* to the pressure detection signal 6*a*. Based on the transfer characteristic, the parameter of the pressure control section 12 is adjusted. With the configuration described above, a further appropriate parameter of the pressure control section 12 can be calculated. As a result, the control performance such as the followability to the pressure command value can be improved while the stability of the control system is ensured.

As in the case of the fifth embodiment, Q(s) is approximately proportional to the elastic constant of the pressurized target 7 even in the sixth embodiment. Therefore, in the case where the type of the pressurized target 7 for the processing device 1 is changed, if an elastic constant of the pressurized target 7 after the change is obtained, a parameter of the pressure control section 12 after the change of the type of the pressurized target 7, which has the same degree of stability margin as in the case where the parameter of the pressure control section 12 before the change of the type of the pressurized target 7 is used, can be easily calculated.

Seventh Embodiment

In general, a processing machine such as various types of molding machines and bonders does not generally process (pressurize) exactly the same work pieces (pressurized targets) but performs a processing operation on various different types of work pieces. Therefore, when the type of work piece is to be changed, the elastic constant of the work piece changes. Therefore, in order to stably perform the pressure control, the parameter for the pressure control is required to be changed in accordance with the characteristics of the work piece.

In order to change the parameter of the pressure control section 12 as described above, it is conceivable to carry out the method described in each of the first to sixth embodiments again each time the type of the pressurized target 7 for the processing device 1 is changed. However, when the elastic constant of the pressurized target 7 does not greatly change (for example, to be equal to or larger than ⅓ times and smaller than three times larger or the like), the change of the parameter can be realized by a simpler method. Therefore, taking the case where the minor loop of the pressure control is the speed control as an example, a method for realizing the change of the parameter is described in a seventh embodiment.

When the elastic constant of the pressurized target 7 greatly changes (for example, to be equal to or larger three times or smaller than ⅓ times larger), the property regarding the transfer characteristic Q(s) (the magnitude of Q(s) is proportional to the elastic constant K of the pressurized target 7) in the fifth and sixth embodiments is not obtained anymore. Therefore, the method described in each of the first to sixth embodiments may be repeated again.

In the second expression in Expression (17), when a frequency region is s=jω (j: an imaginary unit, ω: a parameter indicating a frequency), some change in the magnitude (value) of the elastic constant affects only a linear term of s in a denominator of Q(s) which is the transfer characteristic from the speed command signal 12*a* to the pressure detection signal 6*a* in a high-frequency region (region where ω is relatively large) relating to the stability of the control system. Therefore, in the high-frequency region, a quadratic term or a cubic term becomes dominant. Hence, the magnitude (value) of the entire denominator is not greatly affected.

On the other hand, a numerator of Q(s) is proportional to the elastic constant of the pressurized target 7. From this fact, only by changing the type of the pressurized target 7, the inertia J of the mechanically-movable portion, the viscous friction coefficient d, the parameters Kv and Kvi of the speed control section 13 and the like remain unchanged. Therefore, it can be said that Q(s) has a relationship approximately proportional to the elastic constant of the pressurized target 7. This relationship is similarly established based on Expression (18) even in the case where the minor loop of the pressure control is the position control. The above-mentioned property is likely to be established when the elastic constant does not extremely greatly change after the type of the pressurized target 7 is changed.

Now, it is assumed that the parameter of the pressure control section 12 for the given pressurized target 7 is calculated in accordance with a flowchart of FIG. 26. From the above-mentioned property regarding Q(s), if only the elastic constant of the pressurized target 7 after the change is obtained, Q(s) after the change of the type of the pressurized target 7 can be approximately estimated to be changed so as to be as large as the number of times, which is equal to a value calculated as a ratio of the elastic constant of the pressurized target 7 after the change and the elastic constant of the pressurized target 7 before the change (hereinafter referred to as "ratio of the elastic constants").

Moreover, in order to set the gain margin of the pressure control before the change of the type of the pressurized target 7 and the gain margin of the control pressure after the change of the type of pressurized target 7 to approximately equal to each other, the gain used before the change of the type of the pressurized target 7 may be multiplied by a reciprocal of a value calculated as the ratio of the elastic constants so as to change the parameter of the pressure control section 12. For example, it is supposed that the gain margin of the pressure control section 12 is adjusted to 20 dB for the given pressurized target 7 in accordance with the flowchart of FIG. 26 and the elastic constant of the pressurized target 7 after the change becomes 1.5 times larger than that of the initial pressurized target 7 by changing the type of the pressurized target 7.

At this time, from the above-mentioned property regarding Q(s), Q(s) after the change of the type of the pressurized target 7 becomes approximately 1.5 times larger than Q(s) before the change of the type of the pressurized target 7. From this fact, in order to set the gain margin of the open-loop transfer characteristic, $L(s)=D(s)\cdot Q(s)$, of the pressure control after the change of the type of the pressurized target 7 equal to 20 dB, that is, equal to the gain margin before the change of the type of the pressurized target 7, the parameter of the pressure control section 12 may be set to ½ times as large. Therefore, only from the elastic constant of the pressurized target 7, the parameter of the pressure control section 12 can be easily calculated.

Specifically, in a state before the type of the pressurized target 7 is changed, the parameter-adjusting section 100 previously adjusts the parameter of the pressure control section 12 by any of the methods described in the first to sixth embodiments. Thereafter, after the type of the pressurized target 7 is changed, the parameter-adjusting section 100 uses a product of the elastic constant of the pressurized target 7 before the change and the parameter of the pressure control section 12 before the change as a proportional multiplier to adjust the parameter of the pressure control section 12 so that the proportional multiplier is inversely proportional to the elastic constant of the pressurized target 7 after the change. As a result, the parameter of the pressure control section 12 can be easily adjusted.

In the seventh embodiment, the case where the minor loop of the pressure control is the speed control has been described. Even when the minor loop of the pressure control is the position control or the current control, the same effects are obtained as in the seventh embodiment.

Further, in the first to seventh embodiments, the configuration regarding the pressure control has been described. However, the pressure control in the first to seventh embodiment can be directly replaced by force control. Specifically, a force can be used as the dynamic physical quantity.

The invention claimed is:

1. A motor control device provided to an electric mechanism including a motor, the electric mechanism being connected to a mechanical load for applying a dynamic physical quantity corresponding to any one of a force and a pressure to a target, the electric mechanism displacing the mechanical load to press the mechanical load against the target and apply the dynamic physical quantity to the target by power of the motor, the motor control device comprising:

a motor-control-device main unit that acquires a value of the dynamic physical quantity exerted from the mechanical load to the target as a physical-quantity acquisition value and generating a physical-quantity command value for making the physical-quantity acquisition value equal to a preset physical-quantity target value so as to control driving of the motor by using the physical-quantity acquisition value and the physical-quantity command value, the motor-control-device main unit including a physical-quantity control section that calculates a speed command value based on the physical-quantity acquisition value, and the physical-quantity command value, and a parameter;

a speed control section that calculates a torque command value or a thrust command value for the motor based on a motor-speed detection value detected by speed detecting means for detecting a motor speed of the motor and the speed command value calculated by the physical-quantity control section;

a current control section that controls a current flowing through the motor based on the torque command value or the thrust command value, which is calculated by the speed control section; and a pressure-control-parameter adjusting section including an information-acquiring section that acquires information of an elastic constant of the target, information regarding a reaction force of a motor torque or a thrust, the reaction force being generated with exertion of the dynamic physical quantity from the mechanical load to the target, information of a transfer characteristic from the motor torque or the thrust to the motor speed, a motor position, or a motor acceleration, information of a control law of the speed control section, and information of a parameter of the speed control section, the pressure-control-parameter adjusting section adjusting the parameter of the physical-quantity control section using the information acquired by the information-acquiring section and a transfer characteristic from a signal of the physical-quantity acquisition value to the motor speed that is a transfer characteristic containing a differential characteristic having a reciprocal of the elastic constant of the target as a proportionality constant.

2. A motor control device according to claim 1, wherein:

the information-acquiring section further acquires information of a transfer characteristic of the current control section; and the parameter-adjusting section additionally uses the information of the transfer characteristic of the current control section, which is acquired by the information-acquiring section, to calculate the parameter of the physical-quantity control section.

3. A motor control device according to claim 1, wherein:

the motor-control-device main unit acquires the physical-quantity acquisition value through physical-quantity detecting means for detecting the dynamic physical quantity exerted from the mechanical load to the target;

the information-acquiring section further acquires information of a transfer characteristic indicating a delay characteristic of the physical-quantity detecting means; and the parameter-adjusting section additionally uses the information of the transfer characteristic indicating the delay characteristic of the physical-quantity detecting means, which is acquired by the information-acquiring section, to adjust the parameter of the physical-quantity control section.

4. A motor control device according to claim 1, wherein:

the information-acquiring section further acquires a viscous friction coefficient of a viscous friction generated with a friction torque or a friction thrust, which is proportional to the motor speed, or a viscous friction coefficient obtained by approximating a non-linear friction characteristic with a viscous friction proportional to the motor speed; and the parameter-adjusting section additionally uses information of the viscous friction coefficient acquired by the information-acquiring section to adjust the parameter of the physical-quantity control section.

5. A motor control device according to claim 4, wherein the information-acquiring section acquires the viscous friction coefficient from a value obtained by dividing a gradient of a change in the physical-quantity command value by the elastic constant of the target.

6. A motor control device according to claim 1, wherein, when adjusting the parameter of the physical-quantity control section, the parameter-adjusting section calculates a gain margin and a phase margin of an open-loop transfer characteristic and adjusts the parameter of the physical-quantity control section so that a value obtained by the calculation falls within a predetermined range.

7. A motor control device according to claim 1, wherein the parameter-adjusting section adjusts the parameter of the physical-quantity control section based on the information acquired by the information-acquiring section so that a pole of a closed-loop transfer function falls within a predetermined range.

8. A motor control device according to claim 1, wherein, when a pressurized target is changed, the parameter-adjusting section uses a product of an elastic constant of the pressurized target before the change and the parameter of the physical-quantity control section before the change of the pressurized target as a proportional multiplier to adjust the parameter of the physical-quantity control section after the change of the pressurized target in inverse proportion to the elastic constant of the pressurized target after the change.

9. A motor control device provided to an electric mechanism including a motor, the electric mechanism being connected to a mechanical load for applying a dynamic physical quantity corresponding to any one of a force and a pressure to a target, the electric mechanism displacing the mechanical load to press the mechanical load against the target and apply the dynamic physical quantity to the target by power of the motor, the motor control device comprising:

a motor-control-device main unit that acquires a value of the dynamic physical quantity exerted from the mechanical load to the target as a physical-quantity acquisition value and generating a physical-quantity command value for making the physical-quantity acquisition value equal to a preset physical-quantity target value so as to control driving of the motor by using the physical-quantity acquisition value and the physical-quantity command value, the motor-control-device main unit including a physical-quantity control section that calculates a speed command value based on the physical-quantity acquisition value, the physical-quantity command value, and a parameter;

a speed control section that calculates a torque command value or a thrust command value for the motor based on a motor-speed detection value detected by speed detecting means for detecting a motor speed of the motor and the speed command value calculated by the physical-quantity control section;

a current control section that controls a current flowing through the motor based on the torque command value or the thrust command value, which is calculated by the speed control section; and a parameter-adjusting section including an information-acquiring section that acquires information of an elastic constant of the target, information regarding a reaction force of a motor torque or a thrust, the reaction force being generated with exertion of the dynamic physical quantity from the mechanical load to the target, information of a transfer characteristic from the motor torque or the thrust to the motor speed, a motor position, or a motor acceleration, information of a control law of the speed control section, and information of a parameter of the speed control section, the parameter-adjusting section calculating a transfer characteristic from a speed command signal for the speed command value to a signal of the physical-quantity acquisition value by using the information acquired by the information-acquiring section to adjust the parameter of the physical-quantity control section based on the calculated transfer characteristic.

10. A motor control device provided to an electric mechanism including a motor, the electric mechanism being connected to a mechanical load for applying a dynamic physical quantity corresponding to any one of a force and a pressure to a target, the electric mechanism displacing the mechanical load to press the mechanical load against the target and apply the dynamic physical quantity to the target by power of the motor, the motor control device comprising:

a motor-control-device main unit that acquires a value of the dynamic physical quantity exerted from the mechanical load to the target as a physical-quantity acquisition value and generating a physical-quantity command value for making the physical-quantity acquisition value equal to a preset physical-quantity target value so as to control driving of the motor by using the physical-quantity acquisition value and the physical-quantity command value, the motor-control-device main unit including a physical-quantity control section that calculates a position command value based on the physical-quantity acquisition value, the physical-quantity command value, and a parameter;

a position control section that calculates a speed command value based on a position detection value detected by position detecting means for detecting a motor position of the motor and the position command value calculated by the physical-quantity control section;

a speed control section that calculates a torque command value or a thrust command value for the motor based on a motor-speed detection value detected by speed detecting means for detecting a motor speed of the motor and the speed command value calculated by the position control section;

a current control section that calculates a current flowing through the motor based on the torque command value or the thrust command value, which is calculated by the speed control section; and a parameter-adjusting section including an information-acquiring section that acquires information of an elastic constant of the target, information regarding a reaction force of a motor torque or a thrust, the reaction force being generated with exertion of the dynamic physical quantity from the mechanical load to the target, information of a transfer characteristic from the motor torque or the thrust to the motor speed, a motor position, or a motor acceleration, information of a control law of the position control section, information of a parameter of the position control section, information of a control law of the speed control section, and information of a parameter of the speed control section, the parameter-adjusting section calculating a transfer characteristic from a position command signal for the position command value to a signal of the physical-quantity acquisition value by using the information acquired by the information-acquiring section to adjust the parameter of the physical-quantity control section based on the calculated transfer characteristic.

* * * * *